US010675646B2

(12) United States Patent
Toh et al.

(10) Patent No.: US 10,675,646 B2
(45) Date of Patent: Jun. 9, 2020

(54) DISPENSER SYSTEM

(71) Applicant: Colgate-Palmolive Company, New York, NY (US)

(72) Inventors: Kiat-Cheong Toh, Forest Hills, NY (US); Peter Fallat, II, Whitehouse Station, NJ (US); Francis Tatu, Manlius, NY (US); Brian Balamucki, East Windsor, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/229,012

(22) Filed: Dec. 21, 2018

(65) Prior Publication Data

US 2019/0200813 A1 Jul. 4, 2019

Related U.S. Application Data

(60) Provisional application No. 62/611,710, filed on Dec. 29, 2017, provisional application No. 62/611,719, filed on Dec. 29, 2017.

(51) Int. Cl.
*A47K 5/12* (2006.01)
*B05B 11/00* (2006.01)
(Continued)

(52) U.S. Cl.
CPC ..... *B05B 11/3047* (2013.01); *A47K 5/1201* (2013.01); *A47K 5/1205* (2013.01);
(Continued)

(58) Field of Classification Search
CPC .. B05B 11/0054; B05B 11/3047; B05B 15/30
See application file for complete search history.

(56) References Cited

U.S. PATENT DOCUMENTS 4,322,019 A 3/1982 Smith
5,156,299 A 10/1992 De Caluwe et al.
(Continued)

FOREIGN PATENT DOCUMENTS

| | | |
|---|---|---|
| CN | 103608122 | 2/2014 |
| EP | 3081312 | 10/2016 |
| WO | 2010/083419 | 7/2010 |

OTHER PUBLICATIONS

International Search Report of the International Searching Authority in International Application No. PCT/US2018/067019, dated May 31, 2019.

*Primary Examiner* — J C Jacyna

(57) ABSTRACT

A system for dispensing a fluid, such as a hand soap or the like. The system includes a dispenser and/or a refill cartridge. The dispenser includes a dispenser body having a refill cavity, a dispenser lid configured to be coupled to the dispenser body, and a pump sub-system mounted to the dispenser lid. The pump sub-system includes a first dip tube, a dispensing orifice, and a pump. The refill cartridge includes a cartridge body having a fluid cavity, a store of a fluid in the fluid cavity, and a second dip tube extending into the store of the fluid. The refill cartridge is configured for slidable insertion into and removal from the refill cavity of the dispenser body. The dispenser lid may be coupled to the dispenser body thereby mating the first and second dip tubes to enable dispensing of the fluid.

16 Claims, 12 Drawing Sheets

(51) Int. Cl.
*B05B 15/30* (2018.01)
*A45D 34/00* (2006.01)

(52) U.S. Cl.
CPC ..... *A47K 5/1208* (2013.01); *A47K 5/1211* (2013.01); *B05B 11/0008* (2013.01); *B05B 11/0038* (2018.08); *B05B 11/0054* (2013.01); *B05B 15/30* (2018.02); *A45D 34/00* (2013.01); *A45D 2034/005* (2013.01); *B05B 11/0064* (2013.01); *B05B 11/0097* (2013.01); *B05B 11/3001* (2013.01); *B05B 11/3067* (2013.01)

(56) References Cited

U.S. PATENT DOCUMENTS

| | | | | |
|---|---|---|---|---|
| 5,421,485 | A | 6/1995 | Furuta et al. | |
| 5,769,274 | A * | 6/1998 | Behar | B05B 11/3025 222/95 |
| 5,875,936 | A * | 3/1999 | Turbett | B05B 11/00412 222/207 |
| 8,434,645 | B2 | 5/2013 | Crawford | |
| 10,086,391 | B2 | 10/2018 | Toh et al. | |
| 10,124,357 | B2 * | 11/2018 | Good | B05B 11/3011 |
| 2017/0144176 | A1 | 5/2017 | Toh et al. | |
| 2017/0157629 | A1 | 6/2017 | Toh et al. | |
| 2017/0157630 | A1 | 6/2017 | Toh et al. | |
| 2017/0173615 | A1 | 6/2017 | Toh et al. | |
| 2017/0328361 | A1 * | 11/2017 | Tu | F04B 53/10 |

* cited by examiner

DISPENSER SYSTEM

CROSS-REFERENCE TO RELATED APPLICATIONS

The present application claims priority to U.S. Provisional Patent Application Ser. No. 62/611,710, filed Dec. 29, 2017 and U.S. Provisional Patent Application Ser. No. 62/611,719, filed Dec. 29, 2017, the entireties of which are incorporated herein by reference.

BACKGROUND

Pump style soap dispensers have been in use for quite some time. Dispensers of this type are used until the soap is completely used up or sufficiently depleted so that it can no longer be pumped to the outlet for use. At such time, these dispensers are discarded and replaced with a new dispenser. In these conventional systems, the entire dispenser is discarded together as a single unit, which results in more waste than is necessary. Alternatively, users may refill their dispensers by manually pouring an additional amount of the soap or other liquid from a large refill container into the dispenser. This process typically results in at least some of the liquid product being spilled onto the countertop or floor, thereby creating an undesirable mess. A final problem with existing dispensers is that a significant amount of the product cannot be evacuated from the container. Thus, there is a need for a convenient and mess-free system that allows for replenishment of the liquid product that can be easily achieved by persons of all ages and dexterity and that enables some components of the system to be used with multiple replenishment cartridges, thereby reducing waste. Furthermore, there is a need for a dispenser of liquid product that enables a greater amount, and preferably all, of the liquid product to be dispensed for use.

BRIEF SUMMARY

The invention is directed to a system for dispensing a fluid, such as a hand soap or the like. The system includes a dispenser and/or a refill cartridge. The dispenser includes a dispenser body having a refill cavity, a dispenser lid configured to be coupled to the dispenser body, and a pump sub-system mounted to the dispenser lid. The pump sub-system includes a first dip tube, a dispensing orifice, and a pump. The refill cartridge includes a cartridge body having a fluid cavity, a store of a fluid in the fluid cavity, and a second dip tube extending into the store of the fluid. The refill cartridge is configured for slidable insertion into and removal from the refill cavity of the dispenser body. The fluid system is designed so that a user can readily and easily change out/replace the refill cartridge for use with a common dispenser, dispenser lid, and pump sub-system.

In one aspect, the invention may be a system for dispensing a fluid, the system comprising: a dispenser comprising: a dispenser body comprising a top edge and a refill cavity; a dispenser lid detachably coupled to the dispenser body; and a pump sub-system mounted to the dispenser lid, the pump sub-system comprising a first dip tube, a dispensing orifice, and a pump; a refill cartridge positioned, at least in part, within the refill cavity of the dispenser, the refill cartridge comprising: a cartridge body comprising a shoulder and a fluid cavity; a store of the fluid in the fluid cavity; and a second dip tube located in the fluid cavity and extending into the store of the fluid; wherein the shoulder of the cartridge body contacts the top edge of the dispenser to support the refill cartridge in the refill cavity of the dispenser body.

In another aspect, the invention may be a system for dispensing a fluid, the system comprising: a dispenser comprising: a dispenser body comprising a refill cavity; a dispenser lid detachably coupled to the dispenser body; and a pump sub-system mounted to the dispenser lid, the pump sub-system comprising a first dip tube, a dispensing orifice, and a pump; a refill cartridge positioned, at least in part, within the refill cavity of the dispenser, the refill cartridge comprising: a cartridge body comprising a fluid cavity containing a store of the fluid; and a second dip tube located in the fluid cavity and extending into the store of the fluid; wherein the refill cartridge is coupled to the pump sub-system of the dispenser so that moving the pump sub-system away from the dispenser body with the dispenser lid detached from the dispenser body removes the refill cartridge from the refill cavity of the dispenser.

In yet another aspect, the invention may be a system for dispensing a fluid, the system comprising: a refill cartridge comprising: a cartridge body comprising a reservoir portion that defines a fluid cavity and a neck portion that extends from the reservoir portion to an upper edge defining an opening into the fluid cavity, an inner surface of the neck portion comprising a ledge; a store of the fluid in the fluid cavity; a fluid delivery component disposed within the fluid cavity, the fluid delivery component extending from a bottom end to a top end along a fluid delivery axis and comprising an outer surface and a flange extending radially from the outer surface, the flange resting atop the ledge to support the fluid delivery component in the fluid cavity; and a cartridge lid coupled to the cartridge body to seal the opening into the fluid cavity.

In still another aspect, the invention may be a system for dispensing a fluid, the system comprising: a refill cartridge comprising: a cartridge body comprising a fluid cavity and an upper edge defining an opening into the fluid cavity; a store of the fluid in the fluid cavity; a second dip tube located in the fluid cavity and extending into the store of the fluid; and a cartridge lid coupled to the cartridge body to seal the opening into the fluid cavity, the cartridge lid comprising: an induction liner that is induction sealed to the upper edge of the cartridge body; and a cap having an inner edge that surrounds an opening, wherein a second portion of the induction liner is exposed through the opening.

In a further aspect, the invention may be a system for dispensing a fluid, the system comprising: a refill cartridge comprising: a cartridge body comprising a fluid cavity and an upper edge defining an opening into the fluid cavity; a store of the fluid in the fluid cavity; a fluid delivery component disposed within the fluid cavity; and a cap coupled to the cartridge body to seal the opening into the fluid cavity, a portion of the cap overlying the opening of the cartridge body, the portion of the cap comprising an outer portion that surrounds an inner portion, the inner portion being frangible so that it that separates into a plurality of flaps upon being acted upon by an axial force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
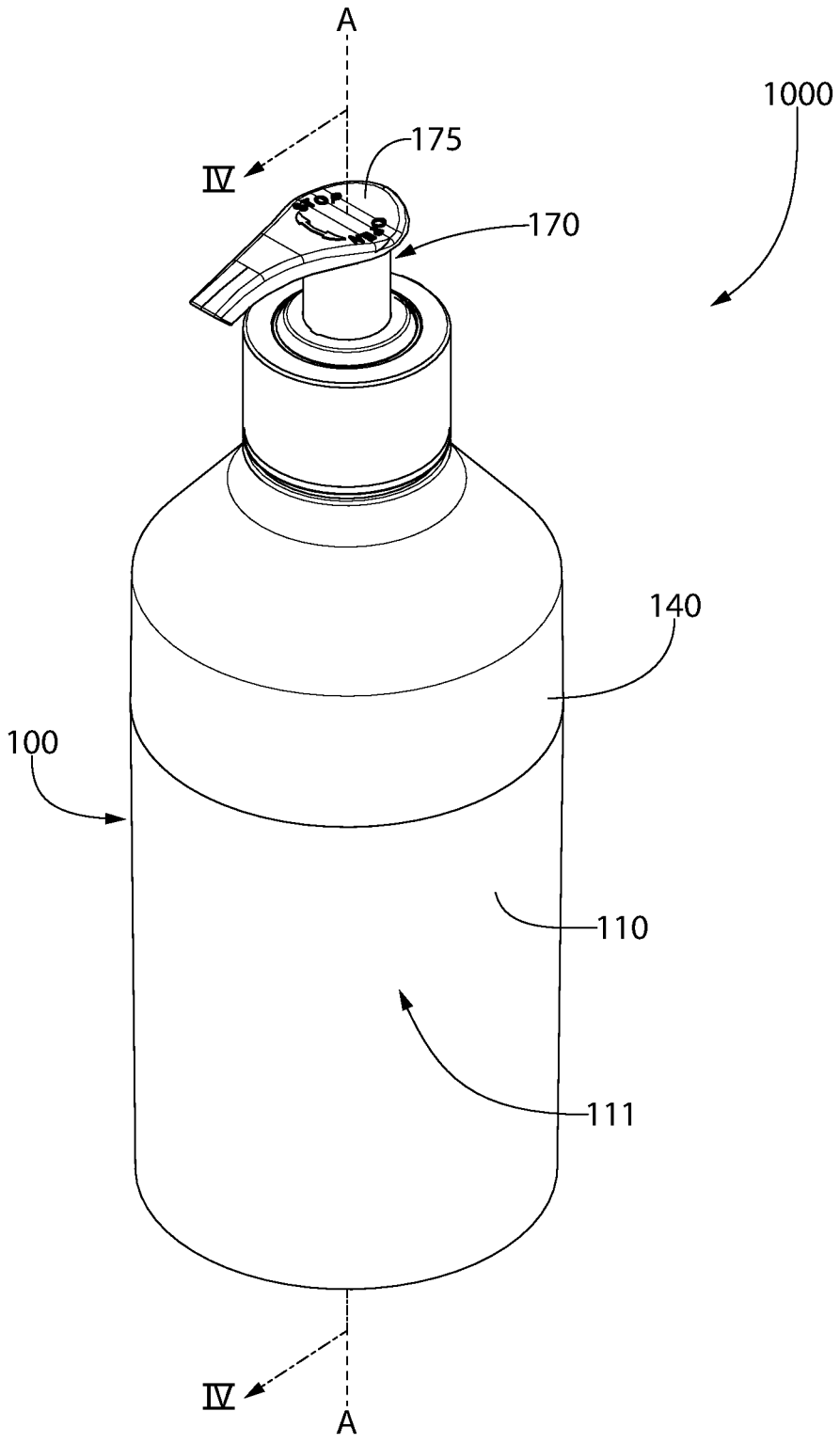
FIG. 1 is a perspective view of a system for dispensing a fluid in an assembled state in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring first to FIGS. 1-4 concurrently, a system for dispensing a fluid (hereinafter "the system") 1000 is illustrated in accordance with an embodiment of the present invention. The system 1000 is illustrated in an assembled state in FIGS. 1 and 4 and in a disassembled or partially disassembled state in FIG. 2. The system 1000 comprises several parts or components that, when assembled, operate as a unit to dispense a fluid (such as a personal care fluid or the like) for use by a user in a desired manner. More specifically, the system 1000 comprises a dispenser 100 and a refill cartridge 200. The dispenser 100 comprises a dispenser body 110 having a refill cavity 113, a dispenser lid 140, and a pump sub-system (or pump assembly) 170. The pump sub-system 170 comprises a first dip tube 171, a dispensing orifice 172, a dosage housing 185 within which a dosage chamber 186 is located, and a pump 173. The refill cartridge 200 comprises a cartridge body 210 comprising a fluid cavity 213 containing a store of a fluid 205, a fluid delivery component 270 that comprises a second dip tube 250 and a basket 254, and a cartridge lid 260 that seals an open top end of the fluid cavity 213. When the system 1000 is fully assembled, the first and second dip tubes 171, 250 operably mate with one another to enable the system 1000 to dispense the fluid 205 from the dispensing orifice 172. The fluid may be a personal care fluid such as a hand soap, a hair application product such as shampoo, conditioner, mousse, gel, lotion, sanitizer, an oral care fluid such as a dentifrice, a mouthwash, or other fluids used for treatment of the oral cavity, a dish soap, a detergent such as a dish detergent or a laundry detergent, or any other fluid that a user may desire to dispense for personal use. In one embodiment, the personal care fluid may be a liquid soap without limitation to the specific type of soap or its end use.

The dispenser body 110 may be formed from an injection molded plastic and the cartridge body 210 may be formed from a blow molded plastic. More specifically, the cartridge body 210 may be a thin wall blown polyethylene terephthalate (PET). In some embodiments, the dispenser body 110 may have a first rigidity and the cartridge body 210 may have a second rigidity such that the first rigidity is greater than the second rigidity. Thus, the dispenser body 110 may be formed of a harder material than the cartridge body 210. In some embodiments, the vertical force that occurs during pumping and dispensing may be fully or almost fully (i.e., 90% of the force) imparted onto the dispenser body 110 so as not to damage the cartridge body 210 during such pumping and dispensing.

Figure 2:
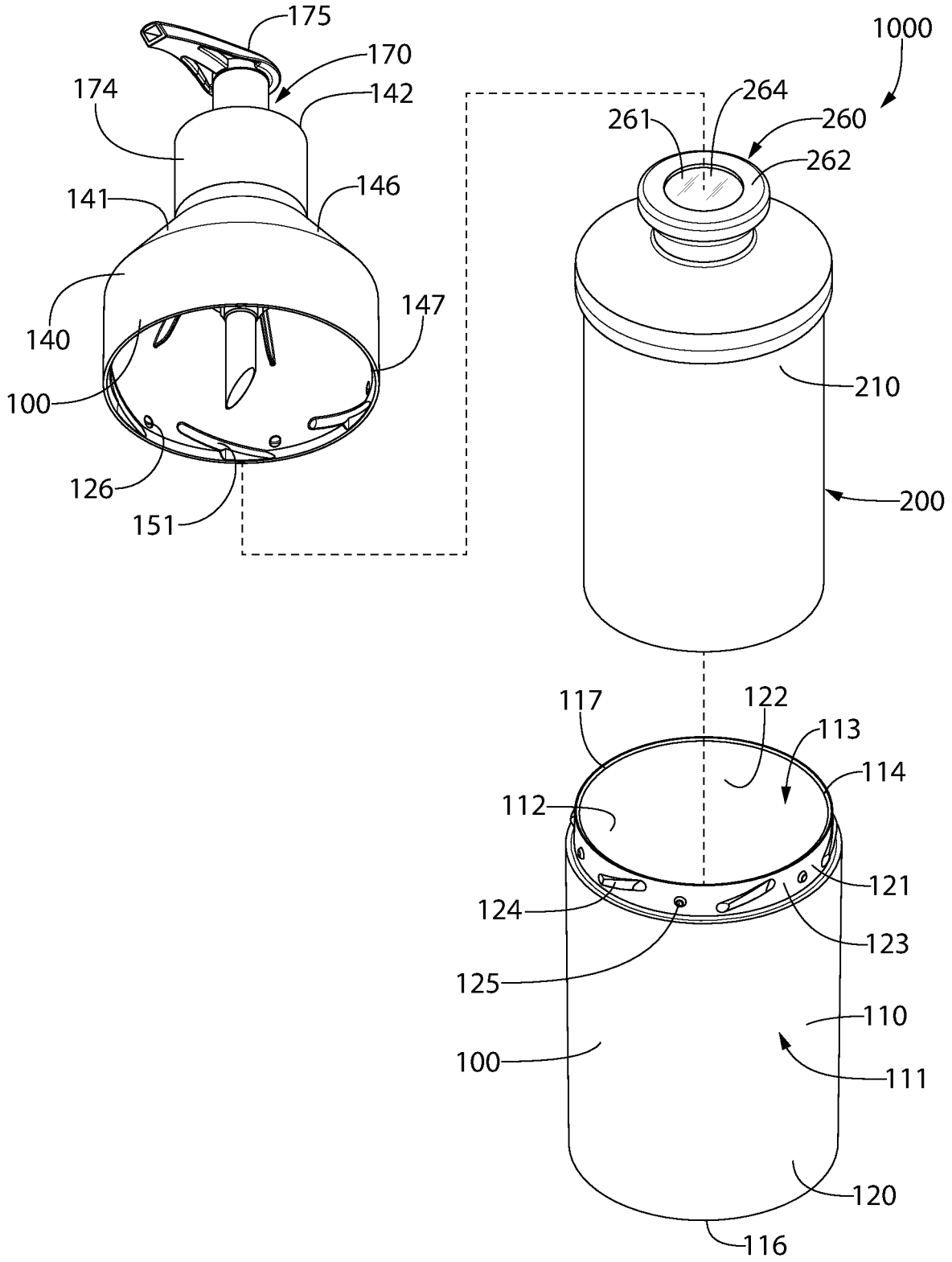
FIG. 2 is a perspective view of the system of FIG. 1 in a disassembled state with a dispenser body, a refill cartridge, and a dispenser lid/pump sub-system detached from one another.

As shown in FIG. 2, the refill cartridge 200 is configured for slidable insertion into and removal from the refill cavity 113 of the dispenser body 100. The dispenser lid 140 with the pump sub-system 170 mounted thereon can then be placed atop of the dispenser body 100 and the refill cartridge 200. The pump sub-system 170 may be detachably coupled to the dispenser lid 140 such that the entire pump sub-system 170 may be separated from the dispenser lid 140 for cleaning or other reasons. In other embodiments, the pump sub-system 170 may be permanently affixed to the dispenser lid 140. As described herein, in some embodiments the dispenser lid 140 has features that mate with features of the dispenser body 110 to couple the dispenser lid 140 to the dispenser body 110. The refill cartridge 200 remains located within the refill cavity 113 of the dispenser body 110 and may be suspended within the refill cavity 113.

Thus, the dispenser body 110 forms an outer container of the system 1000 and the refill cartridge 200 forms an inner container of the system 1000. The refill cartridge 200 can be replaced when the fluid 205 contained therein is depleted or when it is desired to swap the fluid 205 out for a different personal care fluid. For example, if a user no longer enjoys the scent of a particular soap, the user can remove the refill cartridge 200 that is currently located in the dispenser body 100 and replace it with a different refill cartridge having a different personal care fluid therein. The dispenser 100 (including the dispenser body 110, the dispenser lid 140, and the pump sub-system 170) may be reused with multiple refill cartridges 200. The refill cartridge 200 does not have its own pump, but rather only works when coupled to the pump sub-system 170 of the dispenser 100.

Figure 4:
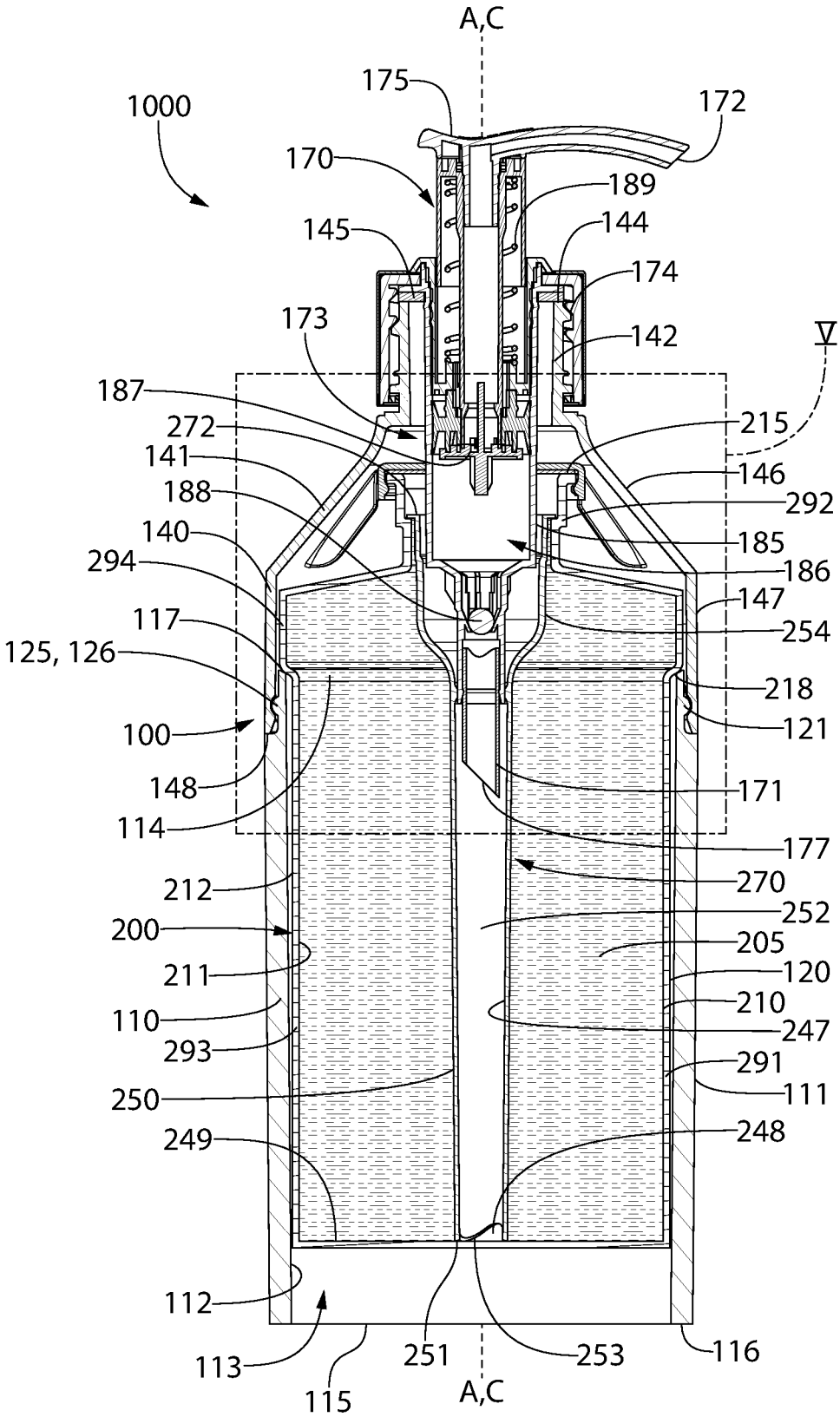
FIG. 4 is a cross-sectional view taken along line IV-IV of FIG. 1.

Referring to FIGS. 1, 2, and 4, the dispenser body 110 will be further described. In the exemplified embodiment, the dispenser body 110 is formed of an opaque material. Of course, this is not required in all embodiments and the dispenser body 110 may be transparent or translucent in other embodiments. In still other embodiments, a label may be provided on the dispenser body 110 to provide product information to consumers, including details related to the type of product stored in the dispenser body 110 and the company that manufactures the product. The label may also have an ornamental aspect to it, such as by comprising flowers, snowflakes, or some other visual depiction that is relevant to the scent of the product being dispensed by the system 1000.

The dispenser body 110 comprises an outer surface 111 and an inner surface 112 opposite the outer surface 111. The inner surface 112 of the dispenser body 110 defines the refill cavity 113 that is sized and configured for receiving the refill cartridge 200 therein as described in more detail herein below. In the exemplified embodiment, the refill cavity 113 has an open top end 114 located at a top edge 117 of the dispenser body 110 and an open bottom end 115 located at a bottom edge 116 of the dispenser body 110. Of course, the bottom end 115 need not be open in all embodiments. In the exemplified embodiment, the dispenser body 110 has a circular transverse cross-sectional shape such that the top edge 117 of the dispenser body 110 is circular. However, the invention is not to be so limited in all embodiments and the dispenser body 110 may have a square, rectangular, triangular, or other shaped transverse cross-section in other embodiments. In some embodiments, the shape of the dispenser body 110 or the shape of the refill cavity 113 thereof should match or correspond with the shape of the cartridge body 210 so that the cartridge body 210 can be inserted into the refill cavity 113.

The dispenser body 110 extends along a dispenser axis A-A from the top edge 117 to the bottom edge 116. Thus, the dispenser body 110 of the exemplified embodiment is a tube-like container that is open on both opposing ends thereof. The refill cavity 113 may have a constant transverse cross-sectional area along its length and the transverse cross-sectional area may be circular (as shown) or rectangular or square. Of course, in other embodiments only the top end 114 may be open and the bottom end 115 may be closed. However, forming the dispenser body 110 with the open top and bottom ends 114, 115 eases manufacturing of the dispenser body 110 via an injection molding operation/process. Generally, the refill cartridge 200 is inserted into (and removed from) the refill cavity 113 via the open top end 114 of the dispenser body 110. In the exemplified embodiment, the refill cartridge 200 cannot be inserted into the refill cavity 113 via the open bottom end 115 because it does not fit, but the cartridge body 210 and/or the dispenser body 110 could be reconfigured so that the cartridge body 210 fits through the bottom end of the dispenser body 110 in other embodiments.

Figure 5:
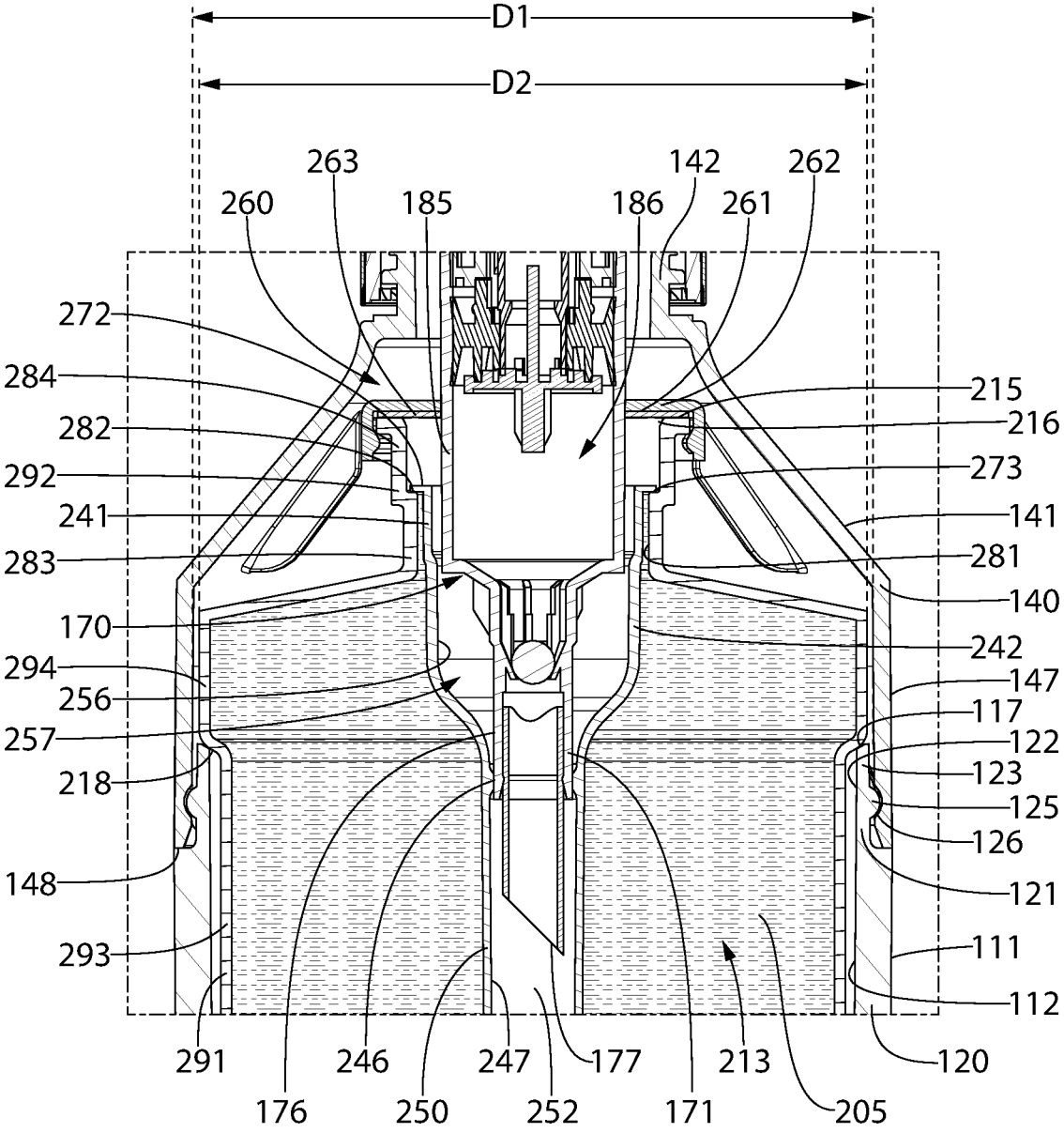
FIG. 5 is a close-up view of area V of FIG. 4.

Referring to FIGS. 2, 4, and 5, the dispenser body 110 comprises a body portion 120 and a neck portion 121 extending from an end of the body portion 120. The neck portion 121 is offset radially inward relative to the body portion 120 so that the dispenser lid 140 can be coupled to the dispenser body 110 along the neck portion 121 thereof. The neck portion 121 comprises an inner surface 122 and an outer surface 123 opposite the inner surface 122. In the exemplified embodiment, the top edge 117 of the dispenser body 110, which is also the top edge of the neck portion 121 of the dispenser body 110, is oriented at an oblique angle relative to the dispenser axis A-A. Stated another way, the top edge 117 of the dispenser body 110 is oriented at an oblique angle relative to the inner and outer surfaces 122, 123 of the neck portion 121 of the dispenser body 120. In the exemplified embodiment, the top edge 117 of the dispenser body 110 slopes upwardly from the inner surface 122 of the neck portion 121 to the outer surface 123 of the neck portion 121.

In this embodiment, there is a first coupling element 124 provided on the outer surface 123 of the neck portion 121 of the dispenser body 110. Of course, it may be possible for the first coupling element 124 to be located on the inner surface 122 of the neck portion 121 of the dispenser body 110 or at other locations along the dispenser body 110 in other embodiments. In the exemplified embodiment, the first coupling element 124 comprises a plurality of angled protuberances arranged about the neck portion 121. However, the invention is not to be so limited and the first coupling element 124 could take on other structures. The first coupling element 124 is intended to interact or mate with coupling elements on the dispenser lid 140 so that the dispenser lid 140 can be coupled to the dispenser body 110. In some embodiments, this coupling may be achieved by mating protuberances/recesses as shown, but in other embodiments this coupling may be achieved by an interference fit, a snap fit, hooks, clips, locking mechanisms, or the like. Thus, the exact structure of the first coupling elements 124 and the manner in which the dispenser lid 140 is coupled to the dispenser body 110 is not intended to be limiting of the invention in all embodiments.

Referring to FIGS. 2 and 4, the dispenser lid 140 and the pump sub-system 170 will be further described. The dispenser lid 140 comprises a main body 141 and a neck 142 extending upwardly from the main body 141. The main body 141 and the neck 142 may be integrally formed as a single unitary structure out of a rigid plastic material formed during an injection molding procedure. The dispenser lid 140 may also comprise a separate cap member that is positioned atop of the main body 141 to create a desired aesthetic. The cap member may be coupled to the main body 141 using an adhesive, or alternatively, using interlocking or otherwise engaging mechanical features. The cap member may be formed from a metal material to give the dispenser a more expensive appearance. The cap member may be a metal cladding. Of course, the cap member need not be included in all embodiments (and it is not in the exemplified embodiment).

In the exemplified embodiment, the neck 142 is threaded and terminates in a distal end 144 having an opening 145 to facilitate coupling of the pump sub-system 170 to the dispenser lid 140. The main body 141 has a top portion 146 that slopes downwardly in an angled manner from the neck 142 and a flange 147 that extends from the top portion 146 to a terminal edge 148. In the exemplified embodiment, the flange 147 has a circular or round shape that matches the shape of the top edge 117 of the dispenser body 110, although the invention is not to be so limited in all embodiments.

The flange 147 comprises a plurality of coupling elements 151 that are configured to engage/mate with the coupling elements 124 of the dispenser body 110 to couple the dispenser lid 140 to the dispenser body 110 (see FIG. 4). In the exemplified embodiment, the coupling elements 151 are recesses formed into the inner surface of the flange 147 that mate with the protuberances that form the coupling elements 124 of the dispenser body 110. However, the invention is not to be so limited in all embodiments and the configuration of the coupling elements 151 may take on any structure or form to ensure acceptable mating with the coupling elements 124 of the dispenser body 110. Thus, it is possible in other embodiments for the coupling elements 124, 151 to be comprise engagement features such as screw threads, boss/detent, protrusion/slot, flex tabs, interference-type fit engagement, or the like.

The dispenser lid 140 is configured to be alterable between: (1) a first state in which the top end 114 of the refill cavity 113 is open so that the refill cartridge 200 can be slid into and out of the refill cavity 113 (see FIG. 2); and (2) a second state in which the dispenser lid 140 is coupled to the dispenser body 110 to enclose the top end 114 of the refill cavity 113 (see FIGS. 1, 4, and 5). In the exemplified embodiment, altering the dispenser lid 140 from the first state to the second state is achieved by rotating the dispenser lid 140 relative to the dispenser body 110 in a first rotational direction until the dispenser lid 140 can no longer be rotated in the first rotational direction due to engagement between the coupling elements 151 of the dispenser lid 140 and the coupling elements 124 of the dispenser body 110. When the dispenser lid 140 is in the second state, interaction between the coupling elements 151 of the dispenser lid 140 and the coupling elements 124 of the dispenser body 110 prevent the dispenser lid 140 from being axially translated relative to the dispenser body 110 without the dispenser lid 140 being rotated relative to the dispenser body 110 in a second rotational direction that is opposite the first rotational direction to disengage the coupling elements 124, 151 from each other. When the dispenser lid 140 is in the second state and coupled to the dispenser body 110, the entirety of the refill cartridge 200 is housed within the interior of the dispenser body 110 and dispenser lid 140 such that no portion of the refill cartridge 200 is exposed. The refill cartridge 200 may nonetheless be visible from the exterior if the dispenser body 110 and/or dispenser lid 140 are transparent, but if the dispenser body 110 and dispenser lid 140 are opaque the refill cartridge 200 will not be exposed and will not be visible.

In some embodiments, the coupling of the dispenser lid 140 to the dispenser body 110 creates an audible "click" as the coupling elements 151 of the dispenser lid 140 become fully engaged with the coupling elements 124 of the dispenser body 110. Specifically, referring to FIGS. 2 and 4, there are nub-like protrusions 125 on the neck portion 121 of the dispenser body 110 between adjacent ones of the coupling elements 124 that mate with nub-shaped concavities or recesses 126 on the flange 147 of the dispenser lid 140 once the coupling elements 124, 151 become fully engaged. As the nub-like protuberances 125 enter into the nub-shaped concavities 126, an audible "click" may be heard by the user. Furthermore, the act of the nub-like protuberances 125 entering into the nub-shaped concavities 126 may also be felt by the user in a haptic way. Thus, this signals to the user that the coupling action is complete and is reassuring and satisfying to the user. This also minimizes accidental backing off of the coupled parts when, for example, the system 1000 falls into the sink or the like. This feature leverages the hoop deformation of the flange 147 to deliver a click action that is consistent in effort and longer lasting over time as compared to an interference fit that may start tight and get progressively looser with wear. This is important because the dispenser body 110 and lid 140 are intended to be used over and over again with multiple different refill cartridges 200 so prolonged use is desired.

Typically, containers similar to the cartridge body 210 that house the fluidic material that is to be dispensed are blow molded and have thin walls that can be squeezed. The invention described herein allows this thin-walled cartridge body 210 to be housed within the thicker, more rigid structure of the dispenser body 110 to such an extent that no part of the cartridge body 210 can be seen by a person using the system 1000 to dispense the fluid. This may be done to provide a desired aesthetic, to make the dispensing system appear more robust, or for any number of other consumer-focused reasons. It may also reduce costs because a consumer need only replace the refill cartridge 200, which does not include a pump system at all. The pump sub-system 170, which may be the most expensive component of the system 1000, can be reused with multiple refill cartridges 200 which can reduce costs and waste.

As mentioned briefly above, the pump sub-system 170 comprises the first dip tube 171, the dispensing orifice 172, the dosage housing 185, and the pump 173. The pump sub-assembly 170 also comprises a collar 174 and an actuator 175. The collar 174 has a threaded inner surface that is configured to mate with the threads on the neck 142 of the dispenser lid 140 to couple/mount the pump sub-system 170 to the dispenser lid 140. In that regard, the collar 174 has a greater diameter than the neck 142 to enable the collar 174 to surround the neck 142 during coupling. An outer surface of the collar 174 may be covered with a cap or other coating that matches the cap member described previously to provide for a seamless aesthetic.

In the exemplified embodiment, the first dip tube 171 terminates in a distal end 177 that is angled relative to the axis A-A. In other embodiments, the first dip tube 171 may taper in a direction towards the distal end 177 to form a point at the distal end 177. This enables the first dip tube 171 to be used to puncture a film or other cover that may be place atop the refill cartridge 200, as described in more detail below. The first dip tube 171 may extend further than that which is shown in the exemplified embodiment. Furthermore, distal end 177 of the first dip tube 171 may be flat and horizontally oriented in other embodiments rather than coming to a point.

During assembly, the first dip tube 171 is inserted into and through the opening 145 in the neck 142 of the dispenser lid 140 until the threads of the collar 174 engage the threads of the neck 142. At this time, the collar 174 is rotated relative to the neck 142 so that the threads mate to couple the pump sub-system 170 to the dispenser body 140. The first dip tube 171 extends entirely through the dispenser lid 140 so that it can engage features of the refill cartridge 200 as described more fully below. Once assembled, the personal care fluid can be pumped from the refill cartridge 200 to the orifice 172 in the pump sub-system 170 for dispensing into a user's hand or the like by pressing downwardly on the actuator 175 in the direction of the axis A-A and then releasing the actuator 175. This action, which is the conventional operation for dispensing containers of this type, pumps the personal care fluid to the outlet 172, as described in greater detail below. In other embodiments, the sequence of inserting the first dip tube 171 into the opening of the refill cartridge 200 can happen concurrently with the coupling of the dispenser lid 140 to the dispenser body 110 or even after the dispenser lid 140 is coupled to the dispenser body 110. For example, the pump sub-system 170 may not be mounted to the dispenser lid 140 as the dispenser lid 140 is coupled to the dispenser body 110. The pump sub-system 170 may be mounted to the dispenser lid 140 only after the dispenser lid 140 is coupled to the dispenser body 110 so that the first dip tube 171 penetrates into the refill cartridge 200 only after the dispenser lid 140 and dispenser body 110 are coupled together. Thus, variations in the assembly procedure are possible and can be determined by the consumer.

The first dip tube 171 does not extend to or even near the bottom of the fluid cavity 213 of the refill cartridge 200. Rather, the first dip tube 171 extends to a location that is approximately 25%-40% into the length of the fluid cavity 213. However, the second dip tube 250 of refill cartridge 200 extends to near or at the bottom of the fluid cavity 213. The first and second dip tubes 171, 250 are fluidly coupled together when the dispenser lid 140, with the pump sub-system 170 mounted thereon, is coupled to the dispenser body 110 and the refill cartridge 200 is positioned within the refill cavity 113. As a result, the liquid/fluid in the fluid cavity 213 is able to flow up the second dip tube 250 and then into the first dip tube 171 where it can then be dispensed through the dispensing orifice 172 of the pump sub-system 170.

Figure 3:
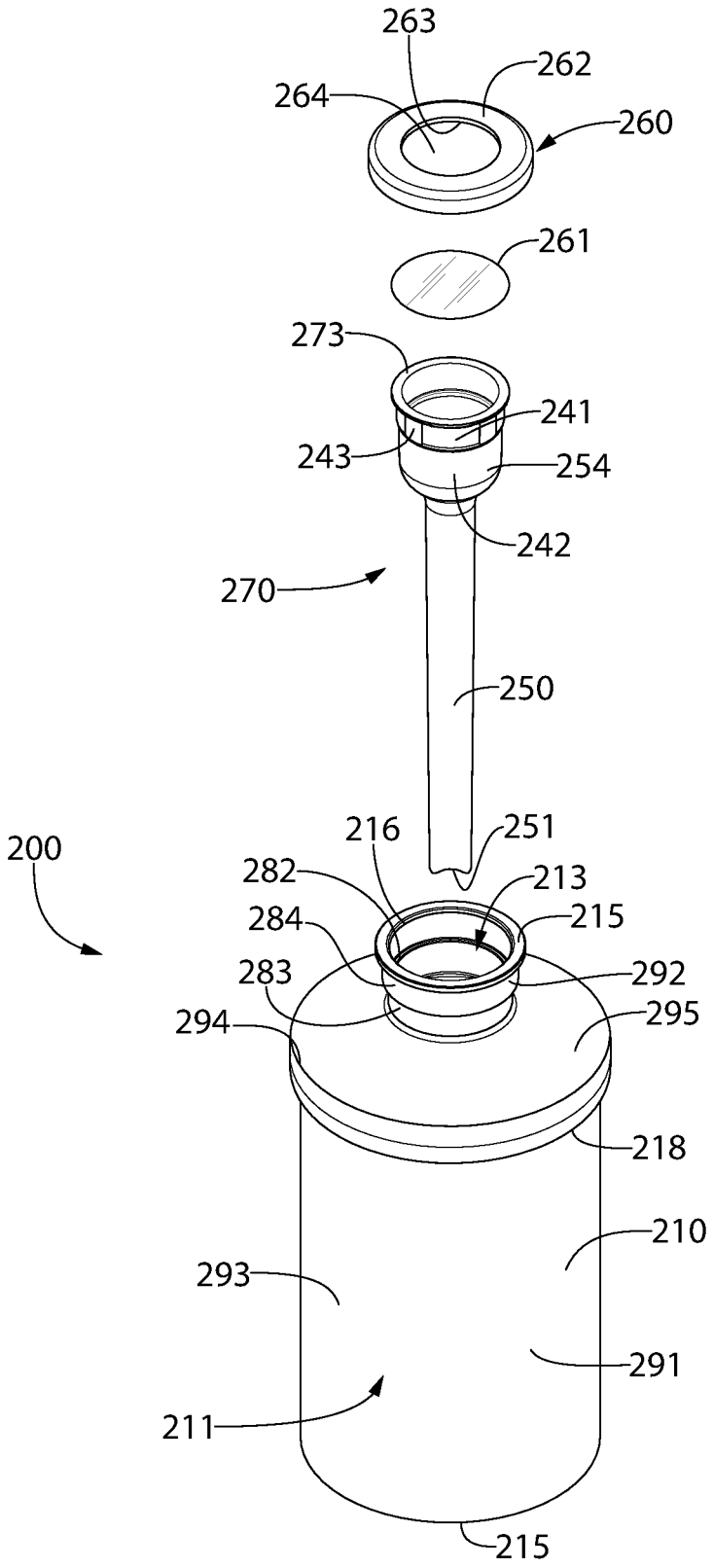
FIG. 3 is an exploded perspective view of the refill cartridge of FIG. 2.

Referring to FIGS. 2-5, the refill cartridge 200 and its components will be described. In FIG. 3, the refill cartridge 200 is illustrated with the cartridge lid 260 and the fluid delivery component 270 exploded from the cartridge body 210. In some embodiments, the fluid delivery component 270, or portions thereof, may be formed integrally with the cartridge body 210 such that the second dip tube 250 cannot be separated/detached from the cartridge body 210. However, in the exemplified embodiment the fluid delivery component 270 is a separate component from the cartridge body 210. When assembled, the fluid delivery component 270 may be coupled to the cartridge body 210 in various ways, including: (1) friction fit into the neck of the cartridge body 210; (2) having an upper portion of the fluid delivery component 270 rest atop of a ledge of the cartridge body 210; and (3) securing the fluid delivery component 270 to the cartridge body 210 via the cartridge lid 260 (i.e., a film lidding or the like) while still permitting the fluid delivery component 270 to rotate relative to the cartridge body 210 and move axially over a limited distance relative to the cartridge body 210. In the exemplified embodiment, the second dip tube 250 is secured to the cartridge body 210 via option (2) above, although other techniques may be used in other embodiments. The particular structure that facilitates the securing of the fluid delivery component 270 to the cartridge body 210 will be described in greater detail below.

The cartridge body 210 of the refill cartridge 200 has an inner surface 211 and an outer surface 212 opposite the inner surface 211. The inner surface 211 of the cartridge body 210 defines the fluid cavity 213 that contains the store of the fluid 205 (shown in FIG. 4). The cartridge body 210 extends from a bottom end 214 to a top end (or upper edge) 215 along a cartridge axis C-C. In the exemplified embodiment, the bottom end 214 of the cartridge body 210 forms a closed bottom end of the fluid cavity 213. Furthermore, an opening 216 is formed into the top end 215 of the cartridge body 210.

The cartridge body 210 comprises an upper neck portion 292 and a lower reservoir portion 291. The upper neck portion 292 comprises the top end 215 of the cartridge body and the lower reservoir portion 291 is the portion within which the fluid 205 is stored. The cartridge body 210 also comprises a shoulder 218 that, in the exemplified embodiment, is located along the lower reservoir portion 291 of the cartridge body 210. The lower reservoir portion 291 of the cartridge body 210 comprises a first portion 293 that extends from the bottom end 214 of the cartridge body 210 to the shoulder 218 and a second portion 294 that extends from the shoulder 218 to a top end 295 of the reservoir portion 291.

In the exemplified embodiment, the shoulder 218 is a downward facing surface of the cartridge body 210 that circumscribes or surrounds the cartridge axis C-C. The shoulder 218 extends continuously about the entire circumference of the cartridge body 210. The shoulder 218 projects radially outwards from the outer surface of the first portion 293 of the lower reservoir portion 291 to form a surface that can be used to engage the top edge 117 of the dispenser body 110 to suspend the refill cartridge 200 within the refill cavity 113. In the exemplified embodiment, the shoulder 218 is oriented at an oblique angle relative to the cartridge axis C-C (and relative to the dispenser axis A-A when the cartridge body 210 is supported within the refill cavity 113 of the dispenser body 110). As discussed in greater detail below, the shoulder 218 of the cartridge body 210 rests atop the top edge 117 of the dispenser body 110 when the cartridge body 210 is supported in the refill cavity 113 of the dispenser body 110. In the exemplified embodiment, the shoulder 218 and the top edge 117 are oriented at the same oblique angle to create a clean and flush interface between those two surfaces/edges.

The neck portion 292 of the cartridge body 210 is free of threads or other connection features because the dispenser lid 140 is not coupled to the cartridge body 210, but it is instead coupled to the dispenser body 110 as described above. The neck portion 292 comprises an inner surface 281 that comprises a ledge 282. The ledge 282 is a horizontal surface that projects from the inner surface 281 of the neck portion 292 so that the fluid delivery component 270 can rest atop the ledge 282, as described in more detail below.

The neck portion 292 of the cartridge body 210 comprises a lower portion 283 located between the ledge 282 and the reservoir portion 291 and an upper portion 284 located between the ledge 282 and the upper edge 215 of the cartridge body 210. In the exemplified embodiments, the ledge 282 is located equidistant between the top end of the reservoir portion 291 and the upper edge 215, although the invention is not to be so limited in all embodiments. Furthermore, in the exemplified embodiment the upper portion 284 of the neck portion 292 has a greater transverse cross-sectional area than the lower portion 283 of the neck portion 292. The ledge 282 is a horizontal surface that is recessed below the upper edge 215 of the cartridge body 210. As will be discussed below, the fluid delivery component 270 rests atop the ledge 282 such that the fluid delivery component 270 is located entirely within the fluid cavity 213 of the cartridge body 210.

In some embodiments, the cartridge body 210 may be manufactured by an injection stretch blow molding process. The cartridge body 210 can take on various shapes and sizes. As described more fully herein below, the cartridge body 210 (or more specifically the fluid cavity 213) is either vented or the cartridge body 210 may contain or be formed by a collapsible bag that holds the store of the fluid 205 therein to enable proper dispensing operations until the fluid 205 is substantially depleted. The cartridge body 210 may be transparent in some embodiments, although the invention is not to be so limited and it may be translucent or opaque in other embodiments. In embodiments in which the cartridge body 210 is transparent, the store of the fluid 205 contained in the fluid cavity 213 of the cartridge body 210 may comprise a color that is visible through the cartridge body 210 and through the dispenser body 110 to create a desired aesthetic and impart information regarding the scent or the like of the fluid 205 to a user or potential purchaser. The cartridge body 210 may also be decorated in ways similar to the described herein for the dispenser body 110.

As mentioned above, the fluid delivery component 270 comprises the second dip tube 250 and the basket 254. The fluid delivery component 270 extends from a bottom end 271 to a top end 272 along a fluid delivery axis (which is the same as the dispenser body and cartridge body axes A-A, C-C noted in FIG. 4). The second dip tube 250 of the refill cartridge 200 comprises a passageway 252 that extends from the basket 254 to a fluid inlet orifice 253 located at a bottom end 251 of the second dip tube 250. The passageway 252 of the second dip tube 250 is sized and configured to receive at least a portion of the first dip tube 171 of the pump sub-system 170 therein. The second dip tube 250 is preferably positioned within the fluid cavity 213 of the cartridge body 210 so that the fluid inlet orifice 253 is in contact with a floor 249 of the fluid cavity 213. This ensures that most, if not all, of the fluid 205 in the fluid cavity 213 will be dispensed which would not occur if the fluid inlet orifice 253 was spaced from the floor 249. Moreover, in the exemplified embodiment the second dip tube 250 comprises at least one notch 248 that extends from the bottom end 251 of the second dip tube 250 upwardly to provide a passageway from the fluid cavity 213 into the passageway 252 within the interior of the second dip tube 250. In the exemplified embodiment, the at least one notch 248 is shaped similar to a mouse hole, although it need not have any particular shape so long as it achieves the desired function as noted herein.

The second dip tube 250 comprises an inner surface 247 that defines the passageway (or interior) 252. Furthermore, the second dip tube 250 comprises at least one protuberance 246 extending from the inner surface 247 and into the passageway 252. In the exemplified embodiment, the at least one protuberance 246 is an annular protuberance that circumscribes an axis of the fluid delivery member 270. However, in other embodiments the at least one protuberance 246 could comprise a plurality of spaced apart protuberances. In the exemplified embodiment, the protuberance 246 is a nub-like projection having a rounded outer surface, although again the invention is not to be limited to this structure and appearance in all embodiments. In the exemplified embodiment, the at least one protuberance 246 is intended to couple the first dip tube 171 of the pump sub-system 170 to the second dip tube 150 of the refill cartridge 100, which provides a coupling between the pump sub-system 170 and the refill cartridge 100 as described further below. Of course, in some embodiments the protuberance 246 could be omitted and the diameters of the first and second dip tubes 171, 250 could be modified to ensure that when the first dip tube 171 is located within the passageway 252 of the second dip tube 250, the first and second dip tubes 171, 250 are coupled together with a friction-type fit.

The fluid delivery component 270 also comprises the basket 254 extending upward from the second dip tube 250. The protuberance 246 is located along the second dip tube 250 at a location that is adjacent to the basket 254. As a result, the first dip tube 171 does not need to extend very far into the second dip tube 250 for the frictional coupling to be achieved between the two. In the exemplified embodiment, the basket 254 and the second dip tube 250 are an integral structure referred to herein as the fluid delivery component 270. In other embodiments, the basket 254 could be separate and distinct component from the second dip tube 250.

The basket 254 comprises an inner surface 256 that defines a basket cavity 257. In the exemplified embodiment, the basket 254 is formed integrally with the second dip tube 250 and the basket 254 and the second dip tube 250 extend along the cartridge axis C-C. However, the basket 254 could alternatively be formed integrally with the cartridge body 210 or it could be its own component separate from the second dip tube 250 and from the cartridge body 210. In some embodiments, the basket 254 is configured to align the first dip tube 171 with the second dip tube 250 and guide the first dip tube 171 into the second dip tube 250 as the dispenser lid 140 is being coupled to the dispenser body 110. As seen in FIG. 5, the basket 254 is located within the neck section 292 of the cartridge body 210 and within the second portion 294 of the reservoir portion 291 of the cartridge body 210. The second dip tube 250 is located within the first portion 293 of the reservoir portion 291 of the container body 210.

The basket 254 comprises a first portion 241 that is adjacent to the top end 272 of the fluid delivery member 270 and a second portion 242 that extends from the first portion 241 to the second dip tube 250. The first and second portions 241, 242 of the basket 254 are distinguishable from one another based on their diameters or transverse cross-sectional areas. Specifically, the first portion 241 has a greater diameter or transverse cross-sectional area than the second portion 242. This is important in some embodiments, particularly those that use an alternative cartridge cap as described below with reference to FIGS. 7A and 7B.

In the exemplified embodiment, the basket 254 comprises one or more vent passageways 243 (visible in FIG. 3) that provide a passageway between the basket cavity 257 and the fluid cavity 213 of the cartridge body 210. In the exemplified embodiment, the vent passageways 243 are located entirely within the first portion 241 of the basket 254. The vent passageways 243 are in fluid communication with the external atmosphere and with the fluid cavity 213 to vent the fluid cavity 213 (i.e., to enable air to pass from the external atmosphere into the fluid cavity 213). Specifically, as is well known, in order to effectuate proper and effective dispensing, when a volume of the fluid 205 is dispensed from the fluid cavity 213, an equal volume of air must be permitted to pass into the fluid cavity 213. The vent openings 255 in the basket 254 enable the flow of air into the fluid cavity 213 as needed.

In the exemplified embodiment, the fluid delivery component 270 comprises a flange 273 that extends radially from an outer surface of the fluid delivery component 270 in a direction away from the axes A-A, C-C. In the exemplified embodiment, the flange 273 is located at the top end 272 of the fluid delivery component 272 such that the flange 273 is flush with the top end 272 and/or forms the top end 272 of the fluid delivery component 272.

As mentioned above, the refill cartridge 200 also comprises the cartridge lid 260. In the exemplified embodiment, the cartridge lid 260 comprises a puncturable film 261 that is induction sealed to the top end 215 of the cartridge body 210 and a cap 262 In some embodiments, the puncturable film 261 may be referred to as an induction liner. The puncturable film 261 may be a transparent film of plastic, a foil, a heat-sealable foil laminate, a thermoplastic material, an aluminum foil, or the like. Specifically, any type of film known for use in sealing the top ends of containers (such as commonly used on pill bottles or the like) can be used as the puncturable film 261. The puncturable film 261 should be designed so that an axial force applied onto the puncturable film 261 will puncture the puncturable film 261 and provide access into the fluid cavity 213 of the cartridge body 210.

The cap 262 may be formed from a hard plastic and comprises an inner edge 263 that defines an opening 264. Thus, the cap 262 is not a fully enclosed cap and if the cap alone were coupled to the top end 215 of the cartridge body 210, the cap 262 would not seal the fluid cavity 213. Rather, the cap 262 is only used in conjunction with the puncturable film 261. In some embodiments, the cap 262 may be omitted and the puncturable film 261 by itself may form the entirety of the cartridge lid 260. The cap 262 may be referred to as being donut-shaped or ring-shaped in some embodiments.

As best seen in FIG. 5, the puncturable film 261 is coupled (preferably induction sealed, although adhesive or other coupling techniques could be used) to the top end 215 of the cartridge body 210. Next, the cap 262 is coupled to the top end 215 of the cartridge body 210 so that the puncturable seal 261 is located between the cap 262 and the top end 215 of the cartridge body 210. The cap 262 covers a first portion 263 of the puncturable film 261 (see FIG. 5) while leaving a second portion 264 of the puncturable film 261 exposed (see FIG. 2). The second portion 264 of the puncturable film 261 is the portion that is punctured in use, and thus it is no longer visible in FIG. 5 because it has been punctured during insertion of the pump sub-system 170. Thus, the cap 262, and more specifically the cartridge lid 260 in its entirety, is never removed from the cartridge body 210, but rather it stays on the cartridge body 260 and the puncturable film 261 thereof is punctured during insertion of the pump sub-system 170 into the fluid cavity 213 of the cartridge body 210. Thus, the puncturable film 161 and the cap 162 need not be removed from the refill cartridge 200, but rather they both remain positioned on the refill cartridge 200 and the puncturable film 161 is punctured during assembly of the system 1000 as described further herein below. The puncturable film 161 may be secured to the top end of 215 of the cartridge body 210 via adhesives, welding, induction sealing, or the like and the cap 262 may be coupled to the top end 215 of the cartridge body 210 after the puncturable film 161 is already secured to the cartridge body 210 in a mechanical manner, such as a snap-fit, interference fit, screw threads, or the like. Of course, the invention is not to be so limited in all embodiments and the cartridge lid 260 may instead be a lid that is removed by a user prior to coupling the dispenser lid 140 to the dispenser body 110. For example, the cartridge lid 260 may be a peel-off lid, a twist-off lid, or a lid that is otherwise removable by a user prior to coupling the dispenser lid 140 to the dispenser body 110.

It should be appreciated that the refill cartridge 200 is entirely free of a pump. Rather, it is only by fully assembling the system 1000 such that the first dip tube 171 of the pump sub-system 170 of the dispenser 100 engages the second dip tube 250 of the refill cartridge 200 that it becomes possible to dispense the fluid 205 from the refill cartridge 200. Thus, the refill cartridge 200 may be sold by itself as a personal care fluid refill container to replace one that has been depleted without having to also sell a pump along with the refill cartridge 200 because the pump sub-system 170, which is a part of the dispenser 100, can be re-used to dispense the personal care fluid from the refill cartridge 200 and any refill cartridge that it is subsequently mated with.

Referring to FIGS. 4 and 5, the relationship between the various components will be described. The refill cartridge 200 is preferably sold with the fluid delivery component 270 already positioned within the fluid cavity 213 and with the cartridge body 210 being sealed by the cartridge lid 260 as described above. The fluid delivery component 270 is suspended within the fluid cavity 213 due to contact between the flange 273 of the fluid delivery component 270 and the ledge 282 on the inner surface 281 of the neck portion 292 of the cartridge body 210. Thus, the flange 273 of the fluid delivery component 270 rests atop the ledge 282 of the cartridge body 210 to support the fluid delivery component 270 in the fluid cavity 213. In the exemplified embodiment, the bottom end 271 of the fluid delivery component 270 is in contact with the floor 249 of the fluid cavity 213, although the bottom end 271 could be suspended slightly above the floor 249 in other embodiments. In some embodiments the contact between the flange 273 and the ledge 282 is the only thing supporting the fluid delivery component 270 in the fluid cavity 213. When so supported, the fluid delivery component 270 is capable of freely rotating relative to the cartridge axis C-C. Furthermore, when so supported the fluid delivery component 270 is capable of moving axially in the direction of the cartridge axis C-C within a pre-determined range of movement (i.e., the flange 273 can move between the ledge 282 and the cap 262).

Furthermore, when the refill cartridge 200 is positioned within the refill cavity 113 of the dispenser body 110, the shoulder 218 of the cartridge body 210 contacts and rests atop of the top edge 117 of the dispenser body 110 to support the refill cartridge 200 in the refill cavity 113 of the dispenser body 110. Thus, the shoulder 218 does not enter into the refill cavity 113, but rather rests directly atop the top edge 117 of the dispenser body 110. In the exemplified embodiment, the shoulder 218 and the top edge 117 are oriented at a similar, if not the same, oblique angle relative to the dispenser axis A-A, which creates a flush, smooth interface between the shoulder 218 and the top edge 117. When supported in the refill cavity 113, the outer surface 211 of the cartridge body 210 is spaced apart from the inner surface 112 of the dispenser body 110 along an entire length of the cartridge body 210 from the shoulder 218 to the bottom end of the cartridge body 210. Furthermore, the refill cartridge 200 is supported within the refill cavity 113 in a suspended manner so that a space exists below the lowermost surface/bottom end of the refill cartridge and a surface (i.e., a shelf, a countertop, a medicine cabinet, or the like) upon which a bottom end 116 of the dispenser 200 rests.

The portion of the cartridge body 210 above the shoulder 218 has a cross-sectional profile that does not fit through the open top end 114 of the dispenser body 110. Thus, when the cartridge body 210 is inserted into the refill cavity 113, the shoulder 218 and the second portion 294 of the reservoir portion 291 cannot pass through the open top end 114 of the dispenser body 110.

In the exemplified embodiment, when the refill cartridge 200 is suspended within the refill cavity 113, a portion of the cartridge body 210 is located within the refill cavity 113 and a portion of the cartridge body 210 protrudes from the top edge 117 of the dispenser body 110 and is not located within the refill cavity 113. More specifically, the first portion 293 of the reservoir portion 291 of the cartridge body 210 is located within the refill cavity 113 and the second portion 294 of the reservoir portion 291 and the neck portion 292 protrude from and are not located within the refill cavity 113. In some embodiments between 15% and 35%, and more specifically 20% and 30%, and still more specifically 22% and 28% of the length of the cartridge body 210 protrudes from the refill cavity 113 of the dispenser body 110 when the shoulder 218 of the cartridge body 210 rests atop the top edge 117 of the dispenser body 110.

In the exemplified embodiment, the neck portion 121 of the dispenser body 110 has an outer diameter D1 and the cartridge body 210 has an outer diameter D2 located just above the shoulder 218. The outer diameter D2 of the cartridge body 210 may be the maximum outer diameter of the cartridge body 210. In the exemplified embodiment, the outer diameter D1 of the neck portion 121 is greater than the outer diameter D2 of the cartridge body 210. This ensures that there is a small gap between the cartridge body 210 and the dispenser lid 140 when the dispenser lid 140 is coupled to the dispense body 110. Thus, the cartridge body 210 does not interfere with the coupling of the dispenser lid 140 to the dispenser body 110.

Furthermore, in the fully assembled system 1000, the first dip tube 171 of the pump sub-system 170 extends into the passageway or the interior 252 of the second dip tube 250 that is located within the fluid cavity 213. Specifically, as the dispenser lid 140 is coupled to the dispenser body 110, the first dip tube 171 of the pump sub-system 170 pierces the cartridge lid 160 and enters into the fluid cavity 213. The fluid delivery component 250 is located within the fluid cavity 213 and spans the entire width of the fluid cavity 213, thereby forcing the first dip tube 171 of the pump sub-system 170 to pass into the basket cavity 257 and then into the passageway 252 of the second dip tube 250. When fully assembled as shown in FIGS. 4 and 5, the dosage housing 185 is located within the neck portion 292 of the cartridge body 210 and within the basket cavity 257 of the basket 254 of the fluid dispensing component 270. Furthermore, a portion of the dosage housing 185 is located within the opening 264 of the cap 262 of the cartridge lid 260. Thus, the dosage housing 185 should have a diameter or transverse cross-sectional area that is at least slightly less than the diameter or cross-sectional area of the opening 264 of the cap 262 to enable the dosage housing 185 to fit through the opening 264 as the pump sub-assembly 170 is being coupled to the refill cartridge 200. The first dip tube 171 extends downwardly from the dosage housing 185 and into the passageway 252 of the second dip tube 250.

As noted previously, the refill cartridge 200 is coupled to the pump sub-system 170 of the dispenser 100. As a result, and as described in greater detail below with reference to FIGS. 10-12, moving the pump sub-system 170 away from the dispenser body 110 will remove the refill cartridge 200 from the refill cavity 113 of the dispenser body 110. The coupling between the pump sub-system 170 and the refill cartridge 200 is achieved in the exemplified embodiment due to an outer surface 176 of the first dip tube 171 being in frictional contact with the inner surface 247 of the second dip tube 250. More specifically, in the exemplified embodiment the protuberance 246 protruding from the inner surface 247 of the second dip tube 250 is in frictional contact with the outer surface 176 of the first dip tube 171. In the exemplified embodiment, the contact between the outer surface 176 of the first dip tube 171 and the inner surface 247 of the second dip tube 250 (and more specifically the protuberance 246 protruding therefrom) is the only physical coupling between the pump sub-system 170 and the refill cartridge 200. Regardless, the frictional coupling between the first and second dip tubes 171, 250 ensures that as the pump sub-system 170 is separated from the dispenser body 110, the cartridge body 210 is removed from the refill cavity 113 of the dispenser body 110.

In certain embodiments, the first dip tube 171 may include a resilient portion so that as the first dip tube 171 begins to contact the protuberance 246, the first dip tube 171, or a portion thereof, will flex radially inward. Thus, the force of the resilient portion of the first dip tube 171 attempting to flex back outward being applied against the protuberance 246 creates a reasonably strong frictional engagement between the first and second dip tubes 171, 250 to achieve the functionality described herein.

Figure 6:
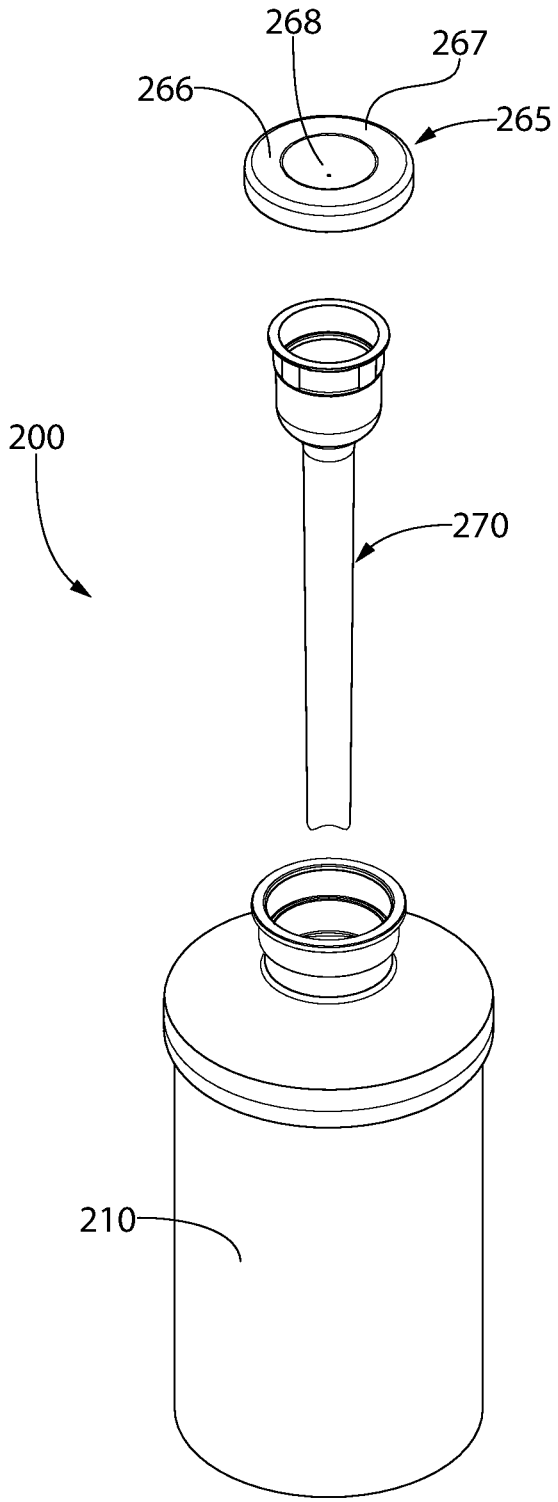
FIG. 6 is an exploded perspective view of a refill cartridge in accordance with an alternative embodiment of the present invention.

FIG. 6 illustrates the refill cartridge 200 in accordance with an alternative embodiment. The refill cartridge 200 comprises the cartridge body 210, the fluid delivery component 270, and a cartridge lid 265. The only difference with this embodiment relative to the embodiment previously described is with regard to the structure of the cartridge lid 265. Specifically, in this embodiment the cartridge lid 265 comprises a top surface 266 having an outer portion 267 and an inner portion 268 that is surrounded by the outer portion 267. The cartridge lid 265 does not have an opening, at least initially. Rather, an axial force must be applied onto the cartridge lid 265 to create an opening. In that regard, in some embodiments the inner portion 268 of the cartridge lid 265 may be frangible so that upon an axial force being applied onto the inner portion 268, the inner portion 268 separates into a plurality of flaps that fold downwardly in the direction of the axial force, thereby creating an opening through the cartridge lid 265. The function and operation of the cartridge lid 265 will be described in greater detail below with reference to FIGS. 9 and 10.

Figure 7:
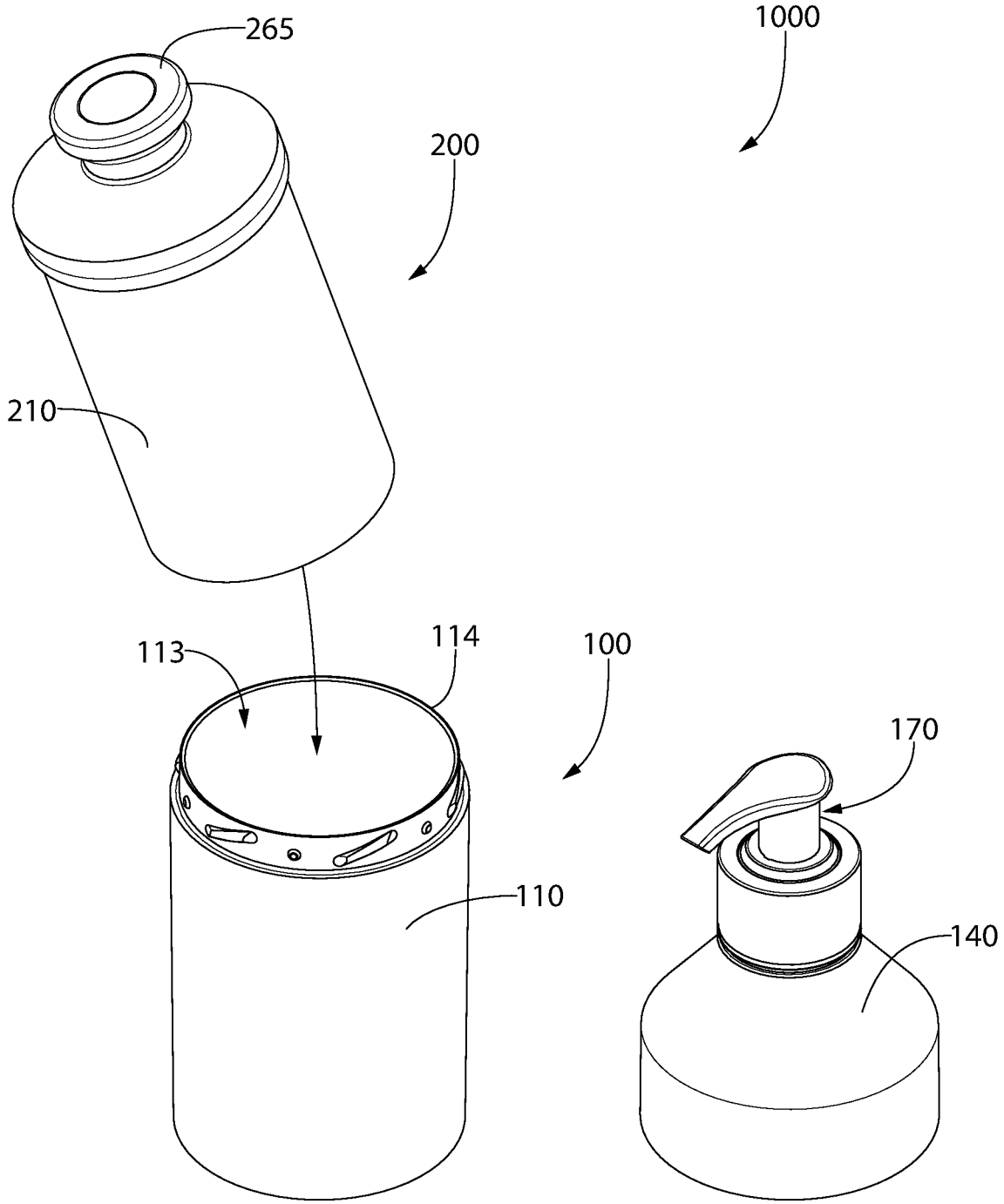
FIG. 7 is a perspective view illustrating the refill cartridge of FIG. 6 being inserted into a refill cavity of the dispenser body.
Figure 8:
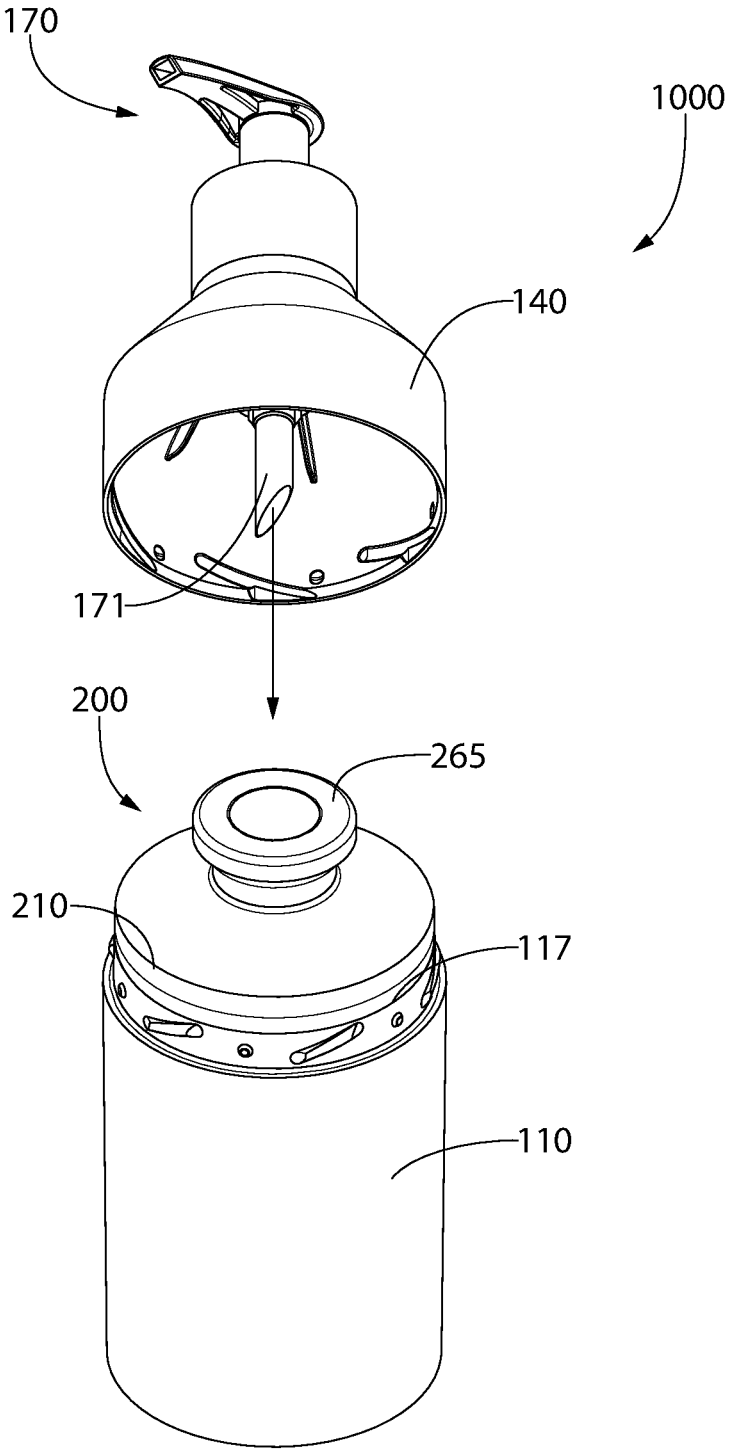
FIG. 8 is a perspective view illustrating the dispenser lid/pump sub-system being attached to the dispenser body with the refill cartridge of FIG. 6 positioned within the refill cavity of the dispenser body.

FIGS. 7 and 8 illustrate the assembly of the system 1000. In FIGS. 7 and 8, the cartridge lid 265 is illustrated instead of the cartridge lid 260. It should be appreciated that the description below is fully applicable to embodiments that use the cartridge lid 260 except where the description is specifically directed to the details of the cartridge lid 265. In FIG. 7, the refill cartridge 200 is illustrated as a sealed unit. The fluid delivery component is not visible because it is fully housed within the fluid cavity of the cartridge body 210 of the refill cartridge 200. In this view, the refill cartridge 200 is being inserted through the open top end 114 of the refill cavity 113 of the dispenser body 110.

FIG. 8 illustrates the system 1000 with the refill cartridge 200 supported within the refill cavity 113 of the dispenser body 110 due to the contact between the shoulder 218 of the cartridge body 210 and the top edge 117 of the dispenser body 110. As seen and described above, a portion of the refill cartridge 200 protrudes from the top edge 117 of the dispenser body 110. The next step in the assembly is to couple the dispenser lid 140 to the dispenser body 110. This is achieved by mating the coupling elements of the dispenser lid 140 with the coupling elements of the dispenser body 110. The dispenser lid 140 has the pump sub-system 170 pre-mounted thereon. Thus, as the dispenser lid 140 is being coupled to the dispenser body 110, the first dip tube 171 of the pump sub-system 170 penetrates the cartridge lid 265 and extends into the fluid cavity 213 of the cartridge body 210.

Figure 9:
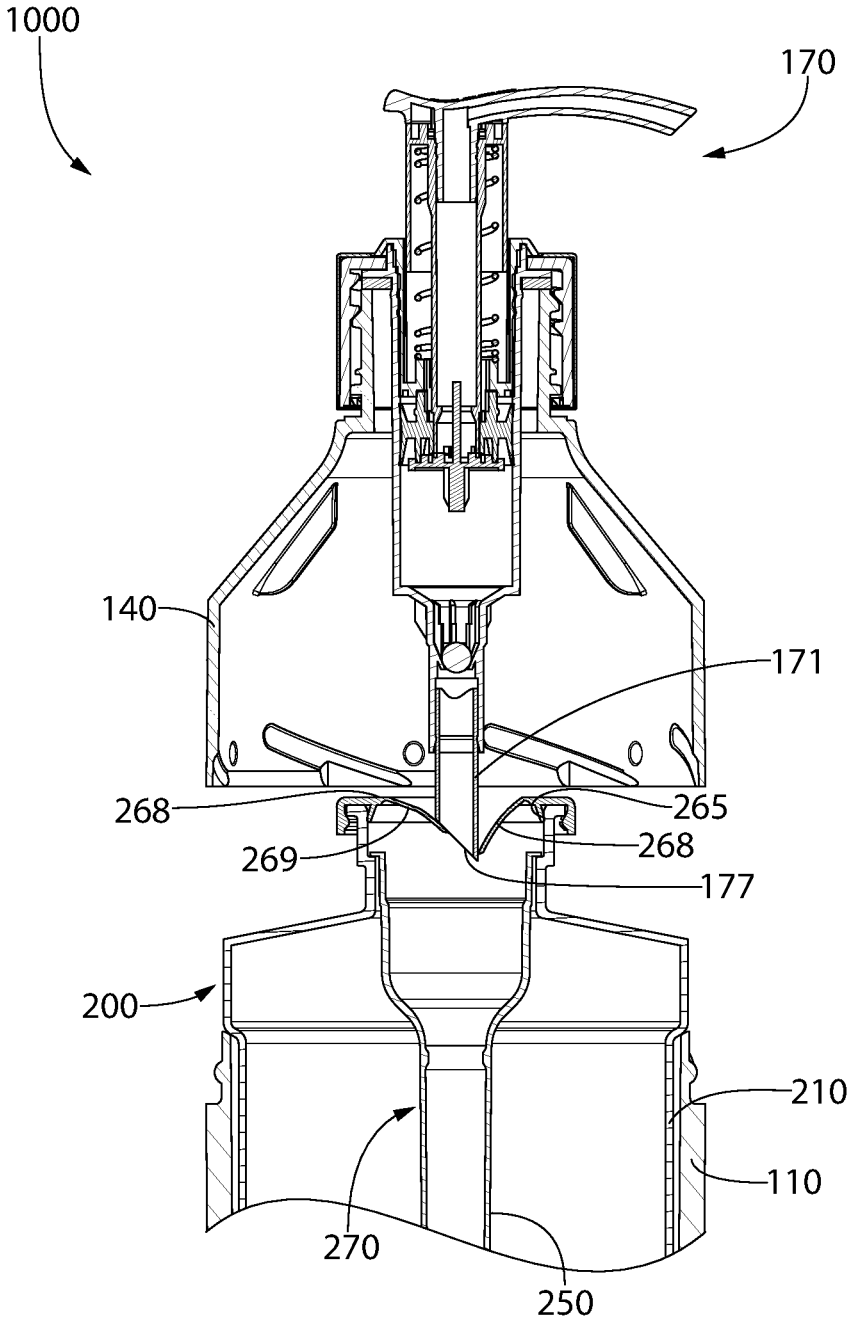
FIG. 9 is a schematic cross-sectional view illustrating the dispenser lid/pump sub-system penetrating a cartridge lid of the refill cartridge of FIG. 6.
Figure 10:
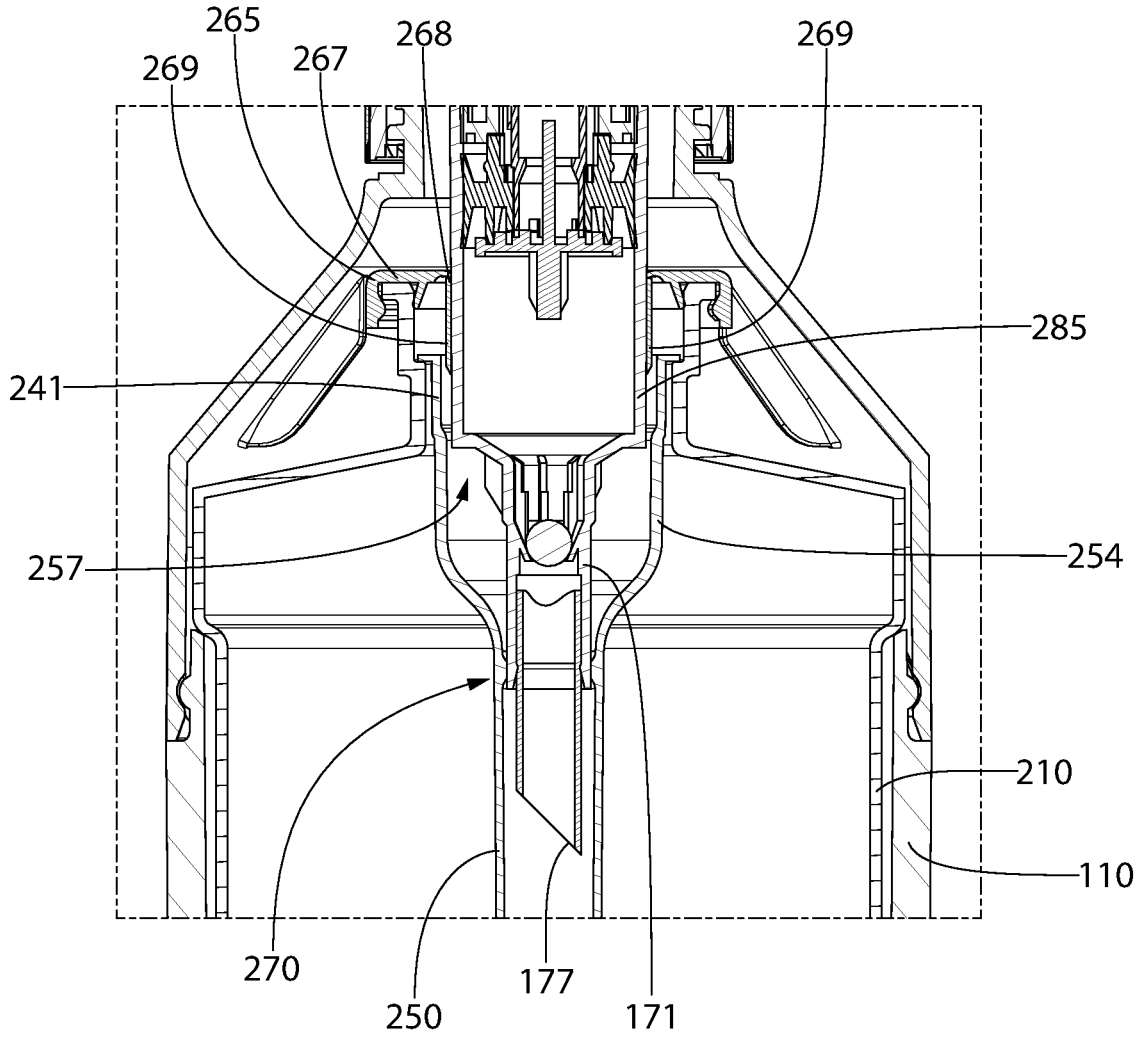
FIG. 10 is a close-up view of area V of FIG. 4 in accordance with an alternative embodiment that includes the refill cartridge of FIG. 6.

Referring to FIGS. 9 and 10, the puncturing of the cartridge lid 265 will be described in greater detail. First, FIG. 9 illustrates the system 1000 with the distal end 177 of the first dip tube 171 contacting the inner portion 268 of the cartridge lid 265. As a user applies a downward force to move the dispenser lid 140 towards the dispenser body 110, the distal end 177 of the first dip tube 171 contacts the inner portion 268 of the cartridge lid 265 and begins to penetrate it. Because the inner portion 268 of the cartridge lid 265 is frangible, the inner portion 268 begins to separate into a plurality of flaps 269. Furthermore, as can be seen in FIG. 9, as the dispenser lid 140 and pump sub-system 170 are moved axially, the contact of the first dip tube 171 with the inner portion 268 of the cartridge lid 265 causes the flaps 269 to begin to bend downwardly relative to the outer portion 267 of the cartridge lid 265.

Of course, it should be appreciated that in some embodiments the first dip tube 171 may be omitted. For example, in some embodiments the bottom end of the dosage housing 185 may be used to penetrate the cartridge lid 265 rather than the first dip tube 171. In such embodiments, the dosage housing 185 will be fluidly coupled to the fluid delivery member 270 of the refill cartridge 200 to ensure that the fluid 205 can still be pumped from the fluid cavity 213 to the dosage chamber 186, and from there out there the dispensing orifice 172 for use by a consumer.

FIG. 10 illustrates the system 1000 with the dispenser lid 140 coupled to the dispenser body 110. In this position, the first dip tube 171 has moved axially past the cartridge lid 265 and into the interior of the second dip tube 250 as described above. Furthermore, the dosage housing 285 extends through the opening that has been formed into the cartridge lid 265. As the dispenser lid 140 is moved from the position shown in FIG. 9 to the position shown in FIG. 10, the first dip tube 171 and then the dosage housing 285 apply a downward force onto the inner portion 268 of the cartridge lid 265 which causes the flaps 269 to separate from one another and bend downwardly. The flaps 269 are unable to bend back upwardly due to the dosage housing 285 being positioned within the opening of the cartridge lid 265.

Once the system 1000 is fully assembled as shown in FIG. 10, the flaps 269 nest within the basket cavity 257 between the dosage housing 285 and the first portion 241 of the basket 254. The diameter of the first portion 241 of the basket 254 is greater than the combined diameter of the dosage housing 285 and the flaps 269 so that the fluid delivery member 270 can move axially relative to the cartridge body 110 with the flaps 269 located in the space between the dosage housing 285 and the first portion 241 of the basket 254. It should be appreciated that FIGS. 5 and 10 are alternative embodiments illustrating the same thing except that in FIG. 5 the cartridge lid 260 comprising the puncturable film 261 and the cap 262 is used to seal the top end of the cartridge body 210 and in FIG. 10 the cartridge lid 265 is used.

Figure 11:
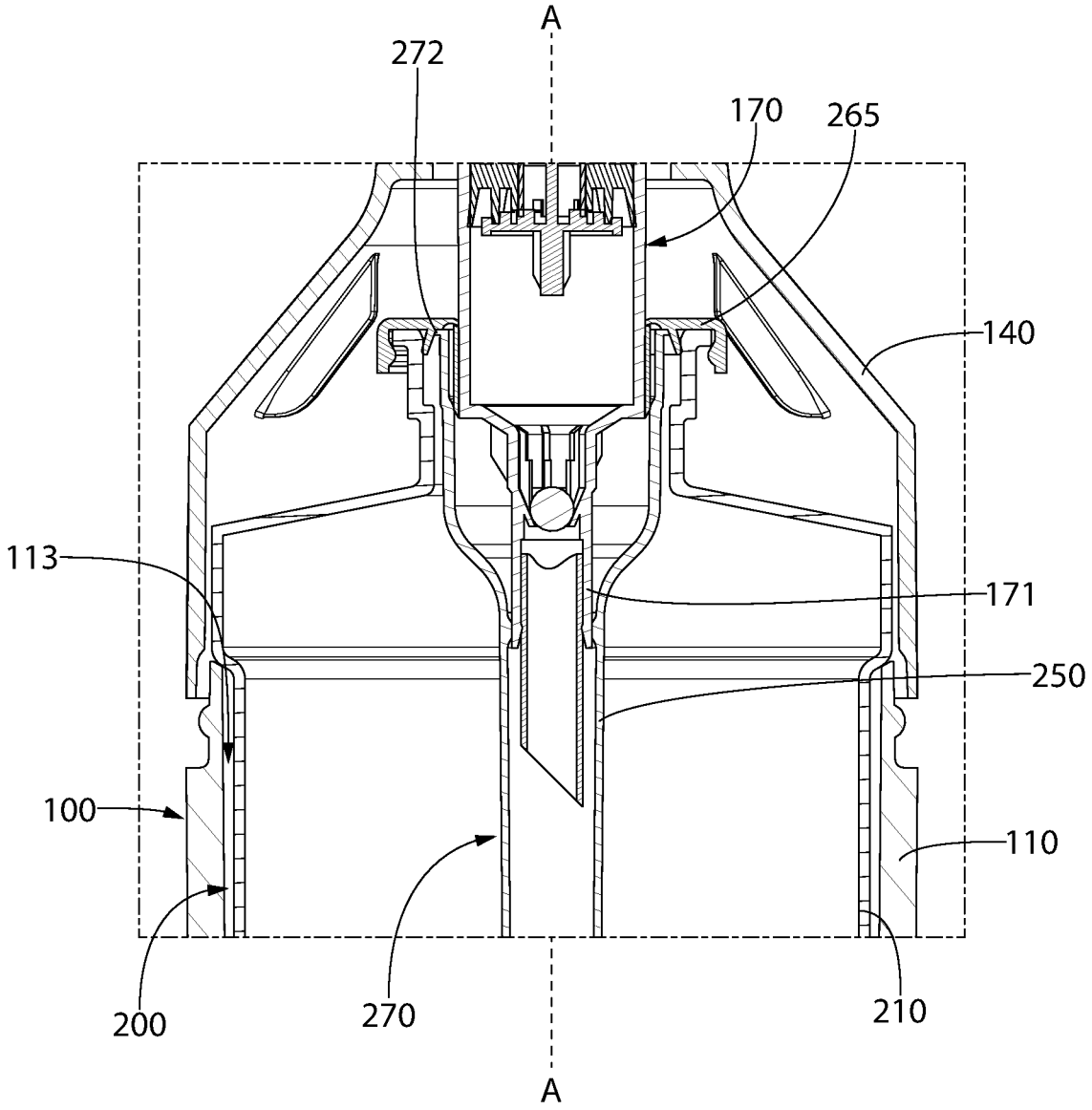
FIG. 11 is the close-up view of FIG. 11 with the dispenser cap and pump sub-system being detached from and moved away from the dispenser body.
Figure 12:
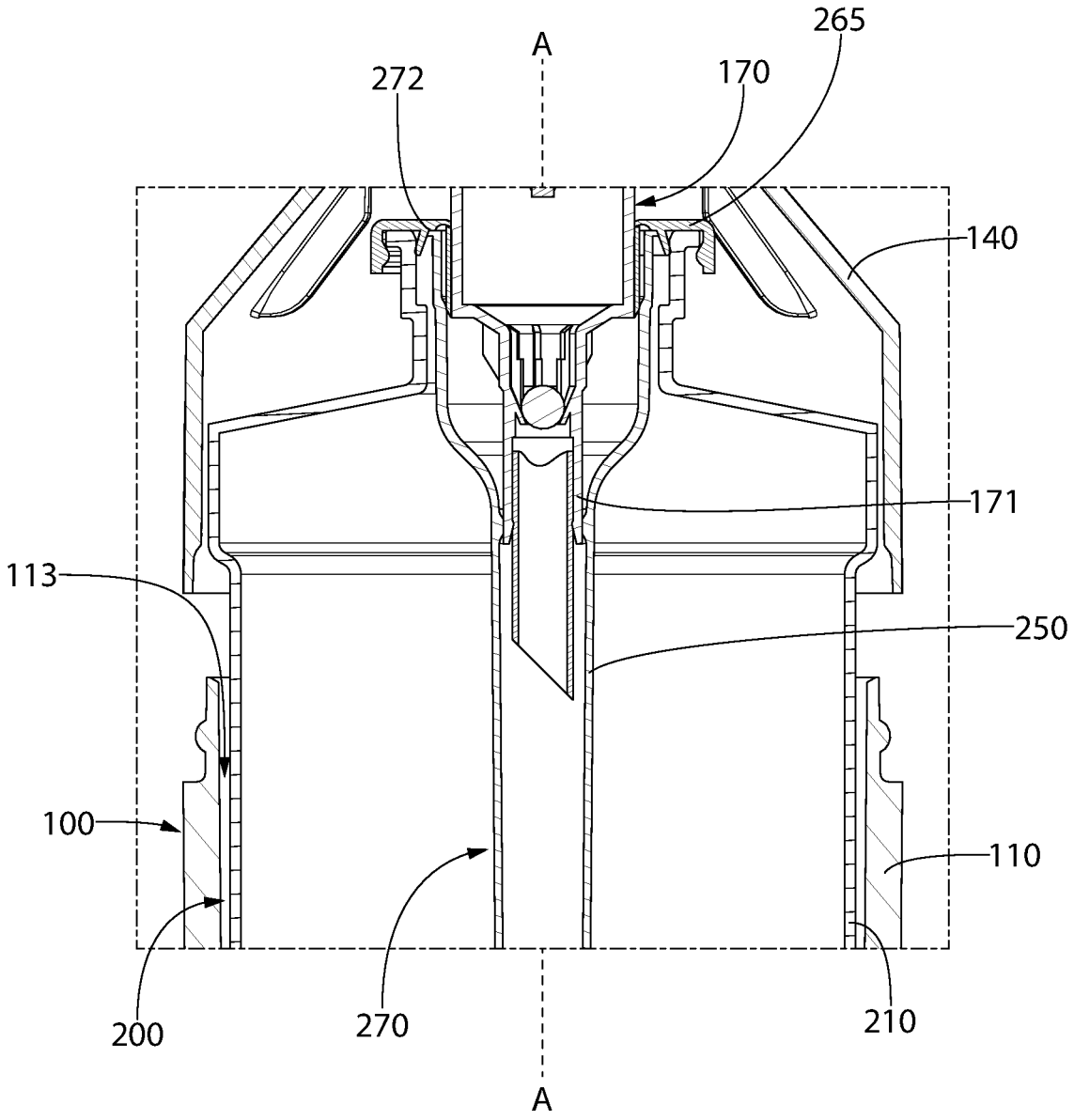
FIG. 12 is the close-up view of FIG. 12 with the dispenser cap and pump sub-system moved further away from the dispenser body to illustrate how this movement also removes the cartridge body from the refill cavity of the dispenser body.

Turning to FIGS. 11 and 12, the process of decoupling the dispenser lid 140 and the pump sub-system 170 from the dispenser body 110 will be described. In some embodiments, the pump sub-system 170 may be decoupled from the dispenser lid 140 and then decoupled from the dispenser body 110. In other embodiments, such as the one described herein, the dispenser lid 140 and the pump sub-system 170 are decoupled from the dispenser body 110 together while the pump sub-system 170 remains mounted to the dispenser lid 140. As will be appreciated from FIGS. 11 and 12 and the accompanying description, moving the pump sub-system 170 away from the dispenser body 110 removes the refill cartridge 200 from the refill cavity 113 of the dispenser body 110. Thus, there is no need for a user to take a separate step to remove the refill cartridge 200 from the refill cavity 113. Rather, this occurs automatically as the pump sub-system 170 (possibly collectively with the dispenser lid 140) is decoupled from and moved away from the dispenser body 110. FIGS. 11 and 12 are illustrated using the cartridge lid 265, but it should be appreciated that the same process is applicable whether the cartridge lid 265 or the cartridge lid 260 is used.

In FIG. 11, the dispenser lid 140 is decoupled from the dispenser body 110 and the dispenser lid 140 is moved a short distance away from the dispenser body 110 in a direction of the dispenser axis A-A. Due to the frictional coupling between the first dip tube 171 and the second dip tube 250 as described above and because the pump sub-system 170 is mounted/coupled to the dispenser lid 140, as the dispenser lid 140 is moved away from the dispenser body 110, the second dip tube 250 moves axially as well. Specifically, the fluid delivery component 270 moves a short distance relative to the cartridge body 210 so that the flange 273 of the fluid delivery component 270 moves from the ledge 282 of the cartridge body 210 to the portion of the cartridge lid 265 that overlies the opening of the cartridge body 210.

Turning to FIG. 12, as the dispenser lid 140 and/or the pump sub-system 170 continues to be moved axially away from the dispenser body 110 in the direction of the dispenser axis A-A, the refill cartridge 200 also moves in the same direction. Specifically, because the first dip tube 171 is coupled to the second dip tube 250, the contact between the fluid delivery component 270 (and specifically the flange 272 thereof) and the portion of the cartridge lid 265 that overlies the opening of the cartridge body 210 causes the refill cartridge 200 and the cartridge body 210 to move along with the dispenser lid 140 and the pump sub-system 170. Thus, as the pump sub-system 170 moves away from the dispenser body 110, the fluid delivery component 270 moves relative to the cartridge body 210 due to its coupling to the first dip tube 171 until the fluid delivery component 270 contacts the cartridge lid 265. Continued movement of the pump sub-system 170 away from the dispenser body 110 causes the cartridge body 210 to move along with the pump sub-system 170 to be removed from the refill cavity 113. Thus, moving the pump sub-system 170 away from the dispenser body 110 will automatically also remove the refill cartridge 200 from the refill cavity 113 of the dispenser body 110.

Turning to FIGS. 1 and 4, to dispense the fluid 205 from the fluid cavity 213, a user will press downwardly on the actuator 175 to actuate the actuator 175. The actuator 175 is operably coupled to a plunger 187 such that when the actuator 175 is actuated, any of the fluid 205 located within the dosage chamber 186 will be forced upwardly to the dispensing orifice 172. This is because the downward pressure of the plunger 187 will ensure that the valve 188 (shown as a ball valve in the exemplified embodiment, but could be any other type of valve in other embodiments) located between the dosage chamber 186 and the fluid cavity 213 remains closed.

The actuator 175 is also operably coupled to a spring 189 such that upon release of the actuator 175, the spring 189 will bias the actuator 175 back into its original non-actuated position. During this biasing of the actuator 175, the valve 188 opens and an amount of the fluid 205 flows from the fluid cavity 213 into the dosage chamber 186. The amount of the fluid 205 is then prepared for dispensing via the dispensing orifice 172 the next time that the actuator 175 is actuated. As mentioned previously, the basket 254 comprises vent passageways 243 that permit the flow of air from the atmosphere into the fluid cavity 213 to replace the amount of the fluid 205 that flows from the fluid cavity 213 into the dosage chamber 186. In alternative embodiments, the fluid cavity 213 could be defined by a collapsible bag such that air is not needed to replace the lost volume of the fluid 205, but instead the collapsible bag will simply collapse thereby reducing the volume of the fluid cavity 213 during dispensing.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A system for dispensing a fluid, the system comprising:
- a dispenser comprising:
  - a dispenser body comprising a top edge and a refill cavity;
  - a dispenser lid detachably coupled to the dispenser body; and
  - a pump sub-system mounted to the dispenser lid, the pump sub-system comprising a first dip tube, a dispensing orifice, and a pump;
- a refill cartridge positioned, at least in part, within the refill cavity of the dispenser, the refill cartridge comprising:
  - a cartridge body comprising a shoulder and a fluid cavity;
  - a store of the fluid in the fluid cavity; and
  - a second dip tube located in the fluid cavity and extending into the store of the fluid; and
- wherein the shoulder of the cartridge body contacts the top edge of the dispenser body to support the refill cartridge in the refill cavity of the dispenser body; and
- wherein the dispenser body comprises a body portion and a neck portion extending from an end of the body portion to the top edge of the dispenser body along a dispenser axis, the neck portion having an inner surface and an outer surface opposite the inner surface, wherein the shoulder of the cartridge body is oriented at an oblique angle relative to the dispenser axis and wherein the top edge of the dispenser body is oriented at an oblique angle relative to the inner and outer surfaces of the neck portion of the dispenser body, the top edge sloping upwardly from the inner surface of the neck portion to the outer surface of the neck portion.

2. The system according to claim 1 wherein the neck portion has an outer diameter that is equal to or greater than a maximum outer diameter of the cartridge body.

3. The system according to claim 1 wherein the cartridge body comprises a cartridge axis, and wherein the shoulder circumscribes the cartridge axis.

4. The system according to claim 1 wherein the refill cartridge further comprises a cartridge lid that seals a top end of the fluid cavity.

5. The system according to claim 1 wherein the refill cartridge comprises a fluid delivery component comprising the second dip tube and a basket, the basket configured to align and guide the first dip tube with the second dip tube as the dispenser lid is being coupled to the dispenser body, wherein the pump sub-system comprises a dosage housing comprising a dosage chamber, the first dip tube extending downward from the dosage housing, and wherein at least a portion of the dosage housing nests within the basket.

6. The system according to claim 1 wherein the cartridge body comprises a reservoir portion extending from a bottom end to a top end and a neck portion extending from the top end of the reservoir portion to a top edge of the cartridge body, the reservoir portion comprising a first portion extending from the bottom end to the shoulder and a second portion extending from the shoulder to the top end, a maximum transverse cross-sectional area of the second portion being greater than a maximum transverse cross-sectional area of the first portion, wherein the first portion of the reservoir portion of the cartridge body is located entirely within the refill cavity and the second portion of the reservoir portion of the cartridge body and the neck portion of the cartridge body protrude from the top edge of the dispenser body and are not located within the refill cavity.

7. The system according to claim 1 wherein the cartridge body extends from a bottom end to a top end and has a length measured from the bottom end to the top end, the shoulder located below the top end so that at least 15% of the length of the cartridge body protrudes from the refill cavity of the dispenser body.

8. A system for dispensing a fluid, the system comprising:
- a dispenser comprising:
  - a dispenser body comprising a refill cavity;
  - a dispenser lid detachably coupled to the dispenser body; and
  - a pump sub-system mounted to the dispenser lid, the pump sub-system comprising a first dip tube, a dispensing orifice, and a pump;
- a refill cartridge positioned, at least in part, within the refill cavity of the dispenser, the refill cartridge comprising:
  - a cartridge body comprising a fluid cavity containing a store of the fluid; and
  - a second dip tube located in the fluid cavity and extending into the store of the fluid; and
- a cap coupled to a top end of the cartridge body, a portion of the cap overlying an open top end of the fluid cavity of the cartridge body;
- wherein the refill cartridge is coupled to the pump sub-system of the dispenser so that moving the pump sub-system away from the dispenser body removes the refill cartridge from the refill cavity of the dispenser body;
- wherein the refill cartridge comprises a fluid delivery component comprising the second dip tube, wherein the fluid delivery component extends along a fluid delivery axis, and wherein during movement of the pump sub-system away from the dispenser body the fluid delivery component moves axially relative to the cartridge body until a top end of the fluid delivery component contacts the portion of the cap so that further movement of the pump sub-system away from the dispenser body causes the cartridge body to be removed from the refill cavity due to the contact between the fluid delivery component and the portion of the cap.

9. The system according to claim 8 wherein the first dip tube extends into an interior of the second dip tube, an outer surface of the first dip tube being in frictional contact with an inner surface of the second dip tube to couple the refill cartridge to the pump sub-system.

10. The system according to claim 9 wherein the frictional contact between the outer surface of the first dip tube and the inner surface of the second dip tube is the only physical coupling between the pump sub-system and the refill cartridge.

11. The system according to claim 9 further comprising at least one protuberance extending from the inner surface of the second dip tube into the interior of the second dip tube, and wherein the protuberance contacts the outer surface of the first dip tube to frictionally couple the first and second dip tubes to one another.

12. The system according to claim 11 wherein the protuberance is an annular protuberance that circumscribes the fluid delivery axis, wherein the first dip tube comprises a resilient portion that flexes radially inwardly upon being contacted by the protuberance as the first dip tube is inserted into the interior of the second dip tube.

13. The system according to claim 8 wherein during movement of the pump sub-system away from the dispenser body, the fluid delivery component contacts the portion of the cap that overlies the open top end of the fluid cavity of the cartridge body to remove the cartridge body from the refill cavity.

14. The system according to claim 8 wherein the cap is ring-shaped and comprises an inner edge that defines an opening, a portion of the pump sub-system extending through the opening in the cap and the first dip tube extending into the interior of the second dip tube.

15. The system according to claim 8 wherein the portion of the cap comprises an outer portion that surrounds an inner portion, the inner portion being frangible so that during insertion of the first dip tube through the open top end of the fluid cavity of the cartridge body the first dip tube causes the inner portion of the cap to separate into a plurality of flaps and bends the plurality of flaps downwardly relative to the outer portion of the portion of the cap.

16. The system according to claim 15 wherein the refill cartridge comprises a fluid delivery component comprising the second dip tube and a basket having a basket cavity, the basket comprising a first portion adjacent to the top end of the fluid delivery component and a second portion extending from the first portion to the first dip tube, and wherein the flaps nest within the basket cavity between a dosage housing of the pump sub-system and the first portion of the basket, wherein the basket cavity has a first diameter within the first portion and a second diameter within the second portion, the first diameter being greater than the second diameter.

* * * * *